United States Patent [19]

Ichijima et al.

[11] Patent Number: 4,533,625

[45] Date of Patent: Aug. 6, 1985

[54] SILVER HALIDE COLOR PHOTOGRAPHIC LIGHT-SENSITIVE MATERIALS

[75] Inventors: Seiji Ichijima; Takeshi Hirose, both of Kanagawa, Japan

[73] Assignee: Fuji Photo Film Co., Ltd., Kanagawa, Japan

[21] Appl. No.: 593,209

[22] Filed: Mar. 26, 1984

[30] Foreign Application Priority Data

Mar. 25, 1983 [JP] Japan ..... 58-50001

[51] Int. Cl.[3] ..... G03C 7/26; G03C 7/32

[52] U.S. Cl. ..... 430/552; 430/553; 430/554; 430/555; 430/556; 430/557; 430/558

[58] Field of Search ..... 430/552, 553, 554, 555, 430/556, 557, 558

[56] References Cited

U.S. PATENT DOCUMENTS

| | | | |
|---|---|---|---|
| 2,480,815 | 8/1949 | Tulagin et al. | 430/552 X |
| 3,615,605 | 10/1971 | Inoue | 430/553 X |
| 4,004,929 | 1/1977 | Orvis | 430/552 X |
| 4,042,393 | 8/1977 | Wada et al. | 430/558 X |
| 4,443,536 | 4/1984 | Lestina | 430/552 |

FOREIGN PATENT DOCUMENTS

| | | | |
|---|---|---|---|
| 557387 | 5/1946 | United Kingdom | 430/552 |

OTHER PUBLICATIONS

Research Disclosure, "Novel Sulfonyl Naphthalene Materials", Aug. 1973.

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A color photographic light-sensitive material which contains a photographic coupler having a naphthalene nucleus in the bonding position other than the coupling position, wherein the naphthalene nucleus contains at least one hydroxyl group and at least one sulfonyl group as a substituent or contains at least one hydroxyl group and at least one sulfinyl group as a substituent is disclosed.

10 Claims, No Drawings

SILVER HALIDE COLOR PHOTOGRAPHIC LIGHT-SENSITIVE MATERIALS

FIELD OF THE INVENTION

The present invention relates to color photographic light-sensitive materials containing a novel coupler.

BACKGROUND OF THE INVENTION

In order to form color photographic images by a subtractive process, a process of forming cyan, magenta and yellow dye images which comprises reducing silver halide grains in exposed or chemically fogged emulsions with a developing agent such as an aromatic primary amine compound, particularly, an N,N-disubstituted p-phenylenediamine compound, to cause reactions of couplers with a simultaneously formed oxidation product of the developing agent is generally utilized.

Couplers used for the above described color developing process are compounds having a phenolic hydroxyl group, an anilinic amino group, an active methylene group or an active methine group which form a dye by oxidative coupling with an aromatic primary amine developing agent.

Suitable couplers which form a cyan dye by reacting with an oxidation product of the color developing agents are phenols and naphthols. Exemplary couplers forming a magenta dye are pyrazolones, pyrazolotriazoles, pyrazolobenzimidazoles, imidazolones, cyanoacetophenones, etc. Couplers forming a yellow dye include $\alpha$-amylacetamides, $\beta$-ketoacetic acid esters, $\beta$-diketones, and N,N-malondiamides.

In order to add couplers as described above to photographic emulsion layers, various methods have been proposed. However, it is preferred to use a method of adding couplers which comprises dissolving couplers with an oleophilic ballast group in the coupler in an organic solvent, and dispersing the solution by emulsification. Characteristics required for such couplers having an oleophilic ballast group in order to produce color light-sensitive materials having excellent photographic properties are as follows. Namely, (1) Couplers and developed dyes formed by color development have high solubility in high boiling point organic solvents (for example, tricresyl phosphate) used for dispersing the couplers.

(2) Silver halide photographic emulsions having dispersed therein the couplers have high stability and when the emulsions are applied to a support and dried, stable coating films are obtained.

(3) They have an excellent antidiffusion property and do not diffuse into other layers.

(4) They have an excellent dyeing property, and dyed color images have an excellent spectral absorption characteristic. Further, they have good color and density stabilities and high fastness to light.

(5) They can be obtained in good purity and high yield from inexpensive raw materials by a simple synthetic process.

Hitherto, many attempts of modifying the structure of ballast group have been made in order to improve the above described characteristics. Examples of these attempts have been described in Japanese Patent Publication Nos. 5582/67, 5391/71 and 27563/64, U.S. Pat. Nos. 2,589,004 and 2,908,573, Japanese Patent Publication No. 3660/69, U.S. Pat. Nos. 2,474,293, 2,039,970 and 2,920,961, Japanese Patent Publication No. 36078/81, British Pat. No. 944,838, Japanese Patent Publication No. 19026/71, U.S. Pat. No. 2,659,329, British Pat. No. 1,513,832, Japanese Patent Application (OPI) No. 76834/78, Japanese Patent Publication No. 36856/79, Japanese Patent Application (OPI) No. 82411/78, German Patent Application (OLS) No. 2,707,488, and Japanese Patent Application (OPI) Nos. 139534/78, 141622/78, 23528/79, 48541/79, 65035/79, 99433/79 and 121126/79, etc.

However, couplers having a ballast group known hitherto have some disadvantages and they do not satisfy the above described characteristics which are required for them. Many of these couplers with an oleophilic ballast group have excellent stability and antidiffusibility in emulsion layers, spectral absorption characteristics of color images, durability of color images and aptitude for synthesis as compared with other types of coupler (for example, couplers having an acid group which are added to emulsion layers as a micellar aqueous solution). However, those which have a satisfactory color forming property have not been found, yet. In rapid processing at high temperature which has been used actively in recent years, the color forming property is particularly important, and insufficient color formation becomes a serious problem. In order to compensate for this insufficient color formation, depending on the circumstances addition of an organic solvent such as benzyl alcohol as a color forming accelerator to the developing solution has been employed. However, organic solvents for accelerating color formation have some disadvantages. For example, (1) Since they are absorbed in the emulsion layers in the development step, the amount thereof in the developing solution is reduced with deterioration of color formation occurring.

(2) They are carried into the bleaching solution or the blixing solution with obstruction of desilvering or deterioration of dye densities occurring.

(3) They remain in the light-sensitive materials after processing deteriorating the fastness of color images.

(4) They are admixed with waste liquors causing an increase of B.O.D. and C.O.D. in the waste liquors. Therefore, it has been highly desired to remove or reduce the amount of organic solvents for accelerating color formation.

In couplers containing a ballast group having a p-hydroxyphenylenesulfonyl group or a p-hydroxyphenylenesulfinyl group at the terminal of the group as described in Japanese Patent Application (OPI) No. 42045/83, improvement of the color forming property is observed as compared with prior couplers, but even so the degree of improvement is not sufficient, yet. Further, they have the disadvantage of having low solubility in organic solvents for dispersing couplers.

SUMMARY OF THE INVENTION

A first object of the present invention is to provide couplers suitable for color photographic light-sensitive materials having excellent photographic properties.

A second object of the present invention is to provide color photographic light-sensitive materials with silver halide emulsions which contain a novel substituent-containing coupler.

A third object of the present invention is to provide color photographic light-sensitive materials using a novel substituent-containing coupler, which have sufficient color forming properties, even if organic solvents for accelerating color formation, such as benzyl alcohol, etc. are not present in the color developing solution or the amount present in the color developing solution is reduced.

A fourth object of the present invention is to provide color photographic light-sensitive materials suitable for rapid treatment at high temperature, using novel couplers.

These objects of the present invention are attained by color photographic light-sensitive materials which contain a photographic coupler having a naphthalene nucleus in a bonding position other than the coupling position, wherein the naphthalene nucleus has at least one hydroxyl group and at least one sulfonyl group as substituents or has at least one hydroxyl group and at least one sulfinyl group as substituents.

DETAILED DESCRIPTION OF THE INVENTION

The term "coupler" as used in this specification includes the following known compounds. Suitable cyan coupler residues are phenols and naphthols. Exemplary magenta coupler residues include pyrazolones, pyrazolotriazoles, pyrazolobenzimidazoles, imidazolones, cyanoacetophenones and the like. Suitable yellow coupler residues are alphaacylacetamide, beta-ketoacetic acid esters, beta-diketones and N,N-malondiamides, etc. In addition to these couplers, resorcinols and 3-aminophenols, etc. can be used as coupler residues which form a black or gray dye by reacting with an oxidation product of the color developing agent. Further, coupler residues which form a colorless compound by reacting with the oxidation product of the color developing agent includes indanones and acetophenones, etc. The coupler residues may have substituents other than hydrogen atom on the position where coupling with the oxidation product of the color developing agent occurs (coupling position).

Preferred couplers of the present invention are those which have a group represented by the following general formula (I) or (II):

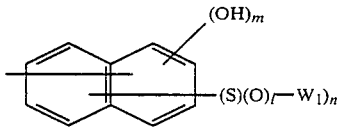

(I)

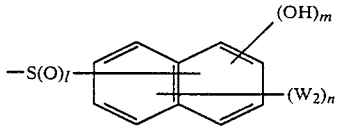

(II)

at a bonding position other than the coupling position of the coupler.

In the formulae, the free bond represents a bond linking the group of the formula (I) or (II) to the remainder of the coupler, l represents an integer of 1 or 2, m represents an integer of 1 to 3, n represents an integer of 1 to 3, $W_1$ represents an unsubstituted or substituted, cyclic, straight-chain or branched-chain saturated or unsaturated alkyl group, an unsubstituted or substituted aryl group, a heterocyclic group (containing at least one of a nitrogen atom, a sulfur atom and an oxygen atom besides carbon atoms, as atoms of the ring), an amino group which may be substituted by an alkyl group, an acylamino group, an alkoxy group, an anilino group or a fluorine atom, and $W_2$ represents a substituent as described in $W_1$ or a hydrogen atom, a chlorine atom, a bromine atom, a carboxyl group, a nitro group, a nitroso group, a cyano group, an alkoxycarbonyl group, a carbamoyl group, a ureido group, an alkoxycarbonylamino group, an imido group, an alkylthio group, an arylthio group, a sulfamoyl group, an alkylsulfonyl group, an arylsulfonyl group, a sulfonamido group, an aryloxy group, an imino group or an acyl group. Where n represents 2 or more, $—S(O)_l—W_1$ groups in the general formula (I) and the $W_2$ groups in the general formula (II) may be the same or different.

Preferred examples of couplers of the present invention are those represented by the following general formulae (III), (IV), (V) and (VI).

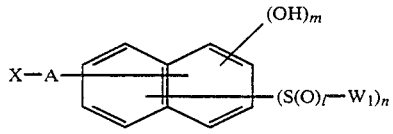

(III)

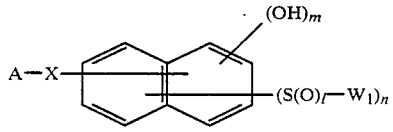

(IV)

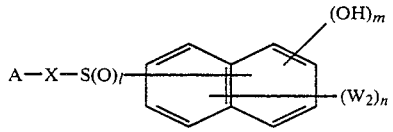

(V)

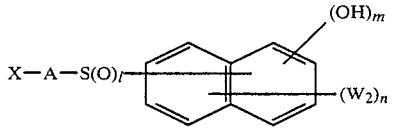

(VI)

wherein $W_1$, $W_2$, l, m and n each have the same meaning as defined in the general formulae (I) and (II), A represents a coupler residue, and X represents an organic residue bonding to the coupler residue A at the coupling position thereof.

Couplers represented by the general formulae (III) and (VI) in the above described general formulae are particularly preferred because they exhibit a greater effect in the present invention.

Examples of yellow image forming coupler residues, for A in the above formulae are pivaloylacetanilide-type, benzoylacetanilide-type, malonic diester-type, malonic diamide-type, dibenzoylmethane-type, benzothiazolylacetamide-type, malonic ester monoamide-type, benzothiazolylacetate-type, benzoxazolylacetamide-type, benzoxazolylacetate-type, benzimidazolylacetamide-type and benzimidazolylacetate-type coupler residues, coupler residues derived from heterocyclic substituted acetamides or heterocyclic substituted acetates described in U.S. Pat. No. 3,841,880, coupler residues derived from acylacetamides described in U.S. Pat. No. 3,770,446, British Pat. No. 1,459,171, German Patent Application (OLS) No. 2,503,099, Japanese Patent Application (OPI) No. 139738/75 and *Research Disclosure,* No. 15737, and heterocyclic coupler residues described in U.S. Pat. No. 4,046,574, etc.

Examples of magenta image forming coupler residues for A are 5-oxo-2-pyrazoline-type, pyrazolobenzimidazole-type, pyrazolotriazole-type and cyanoacetophenone-type coupler residues and N-heterocyclic substituted acylacetamide-type coupler residues described in German Patent Application (OLS) No. 3,121,955, etc.

Examples of cyan image forming coupler residues for A are coupler residues having a phenol nucleus or an α-naphthol nucleus.

Examples of coupler residues which do not substantially form a dye for A include indanone-type coupler residues and acetophenone-type coupler residues. Examples of these types of couplers are described in U.S. Pat. Nos. 4,052,213, 4,088,491, 3,632,345, 3,958,993, 3,961,959, 4,046,574 and 3,938,996, etc.

Known coupling releasing groups can be utilized for X bonding to the coupling position in the general formulae (IV) and (V). In the general formulae (III) and (VI), X may represent a hydrogen atom in addition to known releasing groups. The releasing groups used in the general formulae (IV) and (V) are atomic groups which bond to the coupling position of the coupler component A through a nitrogen atom, an oxygen atom, a carbon atom or a sulfur atom. In the general formulae (III) and (VI), the releasing groups may be halogen atoms.

Representative examples for X are described in detail below.

Specifically, alkoxy groups, acyloxy groups, aryloxy groups, arylthio groups, heterocyclic thio groups, alkylthio groups, sulfonamido groups, heterocyclic oxy groups, nitrogen containing 5-member or 6-member heterocyclic groups (which contain at least one nitrogen atom as the hetero atom and which bond to an active position of the coupler residue through a nitrogen atom, for example, imidazolyl group, triazolyl group, 2,4-dioxoimidazolidinyl group, 3,5-dioxo-1,2,4-triazolidinyl group and pyrazolyl group, etc.), benzene condensed heterocyclic groups (for example, a benzotriazolyl group and a benzimidazolyl group, etc.), arylazo groups, chlorine atom and aliphatic aminomethyl groups, etc., are suitable groups for X.

Where X in the general formulae (IV) and (V) represent the above described releasing groups, they may have the following substituents on a potential substituting position or positions, and they bond directly or through a divalent group to the naphthyl group (of the general formula (I)), the naphthylsulfonyl group (of the general formula (II)) or the naphthylsulfinyl group (of the general formula (II)). Further, the groups for X in the general formulae (III) and (VI) as described above as releasing groups may be substituted with the following substituents on a potential substituting position or positions. Specifically a saturated or unsaturated, cyclic, straight-chain or branched-chain alkyl group having 1 to 32, preferably 1 to 22, carbon atoms, an aryl group having 6 to 10 carbon atoms, a halogen atom, a cyano group, a nitro group, a nitroso group, a carboxyl group, a carbamoyl group, a sulfo group, a hydroxy group, an amino group, a sulfamoyl group, a ureido group, an alkoxy group having 1 to 32, preferably 1 to 22, carbon atoms, (hereinafter the same), an acylamino group, an alkoxycarbonyl group, an alkoxycarbonylamino group, an alkylsulfonamido group, an N-alkyl (or N,N-dialkyl)-sulfamoyl group, an N-alkyl (or N,N-dialkyl)-carbamoyl group, an alkanesulfonyl group, an alkanoyl group, an alkanoyloxy group, an alkylthio group, an aryloxy group having 6 to 10 carbon atoms (hereinafter the same), an aryloxycarbonyl group, an arylsulfonamido group, an N-arylsulfamoyl group, an arylsulfonyl group, an arylthio group, an arylcarbonyl group, an N-arylcarbamoyl group, an arylureido group and an aryloxycarbamoyl group, etc.

In the general formulae (III), (IV), (V) and (VI), any of A, X, $W_1$ and $W_2$ may contain an antidiffusion group, which is an group containing an alkyl group having 8 to 32, preferably 10 to 22, carbon atoms which may contain one or more linking groups such as a phenylene bond, an ether bond, a carbonamido bond, a sulfonamido bond, a ureido bond, a sulfone bond, a thioether bond, a urethane bond, an ester bond, an imide bond, a sulfamido bond, a sulfonediimido bond or a carbonyl bond, etc. The antidiffusion group may be composed collectively of a naphthyl group (the substituent defined in the general formula (I) or (II)) which is a characteristic of the present invention, bonding through the above described linking group or bonding directly, or the above described antidiffussion group may be bonded through the naphthyl group (the substituent defined in the general formula (I) or (II)) which is a characteristic of the present invention.

Further, the effect of the present invention is particularly shown where A in the general formula (III), (IV), (V) or (VI) represents a coupler residue represented by the following general formula (VIII), (VIII), (IX), (X), (XI), (XII), (XIII), (XIV), (XV) or (XVI). Couplers with these coupler residues are preferred because of their high coupling rates.

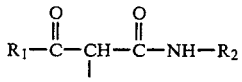
(VII)

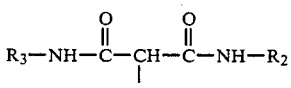
(VIII)

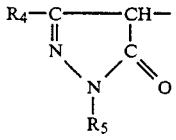
(IX)

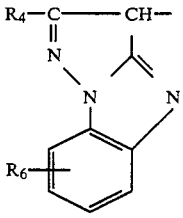
(X)

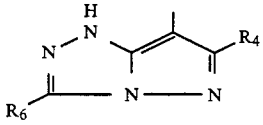
(XI)

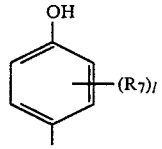
(XII)

-continued

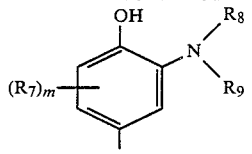

(XIII)

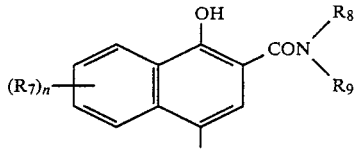

(XIV)

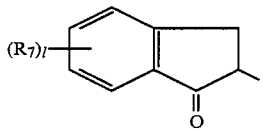

(XV)

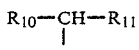

(XVI)

In the above described formulae (VII) to (XVI), the free bond on the coupling position shows the position where the coupling releasing group is bonded. Where $R_1$, $R_2$, $R_3$, $R_4$, $R_5$, $R_6$, $R_7$, $R_8$, $R_9$, $R_{10}$ or $R_{11}$ contains an antidiffusion group, it is selected so that the total number of carbon atoms is 8 to 32 and, preferably is 10 to 22. In other cases, it is selected so that the number of carbon atoms is 15 or less and, preferably 10 or less.

In the formulae, $R_1$ represents an aliphatic group, an aromatic group, an alkoxy group or a heterocyclic group, and $R_2$ and $R_3$ represent each an aromatic group or a heterocyclic group.

In the formulae, the aliphatic group represented by $R_1$ may be any group having, preferably 1 to 22 carbon atoms, which is unsubstituted or substituted and is in the form of a chain or is cyclic. Preferred substituents on the alkyl group are alkoxy groups, aryloxy groups, amino groups, acylamino groups and halogen atoms, which may also be substituted. Examples of preferred aliphatic groups for $R_1$ include the following: an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group and an α-(benzenesulfonamido)isopropyl group, etc.

Where $R_1$, $R_2$ or $R_3$ represents an aromatic group (particularly, a phenyl group), the aromatic group may be substituted. Aromatic groups for $R_1$, $R_2$ or $R_3$, such as a phenyl group, etc., may be substituted with alkyl groups alkenyl groups, alkoxy groups, alkoxycarbonyl groups, alkoxycarbonylamino groups, aliphatic amido groups, alkylsulfamoyl groups, alkylsulfonamido groups, alkylureido groups or alkyl-substituted succinimido groups, etc., each having 32 or less carbon atoms, wherein the alkyl group may contain an aromatic group such as a phenylene group, etc., in the chain. Further, the phenyl group may be substituted with aryloxy groups, aryloxycarbonyl groups, arylcarbamoyl groups, arylamido groups, arylsulfamoyl groups, arylsulfonamido groups or arylureido groups, etc., wherein the aryl moiety of these substituents may be further substituted by one or more alkyl groups having a total of 1 to 22 carbon atoms.

The phenyl group represented by $R_1$, $R_2$ or $R_3$ may be substituted with an amino group including those substituted with lower alkyl groups having 1 to 6 carbon atoms, a hydroxyl group, a carboxyl group, a sulfo group, a nitro group, a cyano group, a thiocyano group or a halogen atom.

Further, $R_1$, $R_2$ or $R_3$ may represent a substituent in which a phenyl group is condensed with another ring to form, e.g., a naphthyl group, a quinolyl group, an isoquinolyl group, a chromanyl group, a coumaranyl group or a tetrahydronaphthyl group, etc., which may also be further substituted.

Where $R_1$ represents an alkoxy group, the alkyl moiety represents a straight or branched-chain alkyl group an alkenyl group, a cycloalkyl group or a cycloalkenyl group, each having 1 to 32, preferably 1 to 22, carbon atoms, which may be substituted by halogen atoms, aryl groups or alkoxy groups, etc.

Where $R_1$, $R_2$ or $R_3$ represents a heterocyclic group, it is linked to the carbon atom of the carbonyl moiety of the acyl group in the α-acylacetamido group or the nitrogen atom of the amido group in the α-acylacetamido group through one of the carbon atoms of the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine and oxazine, etc. These rings may also be substituted as well.

In the general formula (IX), $R_5$ represents a straight-chain or branched-chain alkyl group (for example a methyl group, an isopropyl group, a tert-butyl group, a hexyl group or a dodecyl group, etc.), an alkenyl group (for example, an allyl group, etc.), a cycloalkyl group (for example, a cyclopentyl group, a cyclohexyl group or a norbornyl group, etc.), an aralkyl group (for example, a benzyl group or a β-phenylethyl group, etc.) or a cycloalkenyl group (for example, a cyclopentenyl group or a cyclohexenyl group, etc.), each having 1 to 32 preferably 1 to 22 carbon atoms which may be substituted by halogen atoms, nitro groups, cyano groups, aryl groups, alkoxy groups, aryloxy groups, carboxyl groups, alkylthiocarbonyl groups, arylthiocarbonyl groups, alkoxycarbonyl groups, aryloxycarbonyl groups, sulfo groups, sulfamoyl groups, carbamoyl groups, acylamino groups, diacylamino groups, ureido groups, urethane groups, thiourethane groups, sulfonamido groups, heterocyclic groups, arylsulfonyl groups, alkylsulfonyl groups, arylthio groups, alkylthio groups, alkylamino groups, dialkylamino groups, anilino groups, N-arylanilino groups, N-alkylanilino groups, N-acylanilino groups, hydroxyl groups or mercapto groups, etc.

Further, $R_5$ may represent an aryl group (for example, a phenyl group or an α- or β-naphthyl group, etc.). The aryl group may contain one or more substituents. Examples of suitable substituents include alkyl groups, alkenyl groups, cycloalkyl groups, aralkyl groups, cycloalkenyl groups, halogen atoms, nitro groups, cyano groups, aryl groups, alkoxy groups, aryloxy groups, carboxyl groups, alkoxycarbonyl groups, aryloxycarbonyl groups, sulfo groups, sulfamoyl groups, carbamoyl groups, acylamino groups, diacylamino groups, ureido groups, urethane groups, sulfonamido groups, heterocyclic groups, arylsulfonyl groups, alkylsulfonyl groups, arylthio groups, alkylthio groups, alkylamino groups, dialkylamino groups, anilino groups, N-alkylanilino groups, N-arylanilino groups, N-acylanilino groups, hydroxyl groups and mercapto groups, etc. Preferred examples of $R_5$ are phenyl groups wherein at least one of the ortho positions is substituted with an alkyl group, an alkoxy group or a halogen atom, and these cases are useful, because the coupler remaining in the film undergoes a lesser degree of coloration by light or heat.

Further, $R_5$ may represent a heterocyclic group (for example, a 5-member or 6-member heterocyclic or condensed heterocyclic group containing nitrogen atoms, oxygen atoms or sulfur atoms as hetero atoms, such as a pyridyl group, a quinolyl group, a furyl group, a benzothiazolyl group, an oxazolyl group, an imidazolyl group or a naphthoxazolyl group, etc.), a heterocyclic group substituted by substituents as described for the above described aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the formulae, $R_4$ represents a hydrogen atom, a straight chain or branched-chain alkyl, alkenyl, cycloalkyl aralkyl or cycloalkenyl group having 1 to 32, preferably 1 to 22 carbon atoms (which may be substituted with substituents as described in described above for $R_5$), an aryl group, a heterocyclic group (which may be substituted with substituents as described above for $R_5$), an alkoxycarbonyl group (for example, a methoxycarbonyl group, an ethoxycarbonyl group or a stearyloxycarbonyl group, etc.), an aryloxycarbonyl group (for example, a phenoxycarbonyl group or a naphthoxycarbonyl group, etc.), an aralkyloxycarbonyl group (for example, a benzyloxycarbonyl group, etc.), an alkoxy group (for example, a methoxy group, an ethoxy group or a heptadecyloxy group, etc.), an aryloxy group (for example, a phenoxy group or a tolyloxy group, etc.), an alkylthio group (for example, an ethylthio group or a dodecylthio group, etc.), an arylthio group (for example, a phenylthio group or an $\alpha$-naphthylthio group, etc.), a carboxy group, an acylamino group (for example, an acetylamino group or a 3-[2,4-di-tert-amylphenoxy)acetamido]benzamido group, etc.), a diacylamino group, an N-alkylacylamino group (for example, a N-methylpropionamido group, etc.), an N-arylacylamino group (for example, an N-phenylacetamido group, etc.), a ureido group (for example, a ureido group, an N-arylureido group or an N-alkylureido group, etc.), a urethane group, a thiourethane group, an arylamino group (for example, a phenylamino group, an N-methylanilino group, a diphenylamino group, an N-acetylanilino group or a 2-chloro-5-tetradecanamidoanilino group, etc.), an alkylamino group (for example, an n-butylamino group, a methylamino group or a cyclohexylamino group, etc.), a cycloamino group (for example, a piperidino group or a pyrrolidino group, etc.), a heterocyclic amino group (for example, a 4-pyridylamino group or a 2-benzoxazolylamino group, etc.), an alkylcarbonyl group (for example, a methylcarbonyl group, etc.), an arylcarbonyl group (for example, a phenylcarbonyl group, etc.), a sulfonamido group (for example, an alkylsulfonamido group or an arylsulfonamido group, etc.), a carbamoyl group (for example, an ethylcarbamoyl group, a dimethylcarbamoyl group, an N-methylphenylcarbamoyl group or an N-phenylcarbamoyl group, etc.), a sulfamoyl group (for example, an N-alkylsulfamoyl group, an N,N-dialkylsulfamoyl group, an N-arylsulfamoyl group, an N-alkyl-N-arylsulfamoyl group or an N,N-diarylsulfamoyl group, etc.), a cyano group, a hydroxy group, a mercapto group, a halogen atom or a sulfo group.

In these formulae, $R_6$ represents a hydrogen atom or a straight-chain or branched-chain alkyl group, an alkenyl group, a cycloalkyl group, an aralkyl group or a cycloalkenyl group, each having 1 to 32, preferably 1 to 22, carbon atoms, which may be substituted with substituents as described above for $R_5$.

Further, $R_6$ may represent an aryl group or a heterocyclic group, which may be substituted with substituents as described above for $R_5$.

Further, $R_6$ may represent a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group or a mercapto group.

$R_7$, $R_8$ and $R_9$ represent each a group present in conventional 4-equivalent phenol or $\alpha$-naphthol couplers. For example, $R_7$ represents a hydrogen atom, a halogen atom, an alkoxycarbonylamino group, an aliphatic hydrocarbon residue, an N-arylureido group, an acylamino group, —O—$R_{12}$ or —S—$R_{12}$ (wherein $R_{12}$ represents an aliphatic hydrocarbon residue). Where two or more $R_7$ substituents are present in the same molecule, they may be the same or different, and the aliphatic hydrocarbon residue may be substituted.

Further, where these substituents contain an aryl group, the aryl group may be substituted with substituents described above for $R_5$.

$R_8$ and $R_9$ each represents a group selected from aliphatic hydrocarbon residues, aryl groups and heterocyclic residues. Further, one of $R_8$ and $R_9$ may represent a hydrogen atom. These groups may be substituted with substituents. Moreover, $R_8$ and $R_9$ may combine and form a nitrogen-containing heterocyclic nucleus.

l represents an integer of 1 to 4, m represents an integer of 1 to 3, and n represents an integer of 1 to 5.

Examples of representative aliphatic hydrocarbon residues include any saturated groups and unsaturated groups and any straight chain groups, branched chain groups and cyclic groups. Preferred examples of aliphatic residues are alkyl groups (for example, methyl, ethyl, propyl, isopropyl, butyl, t-butyl, isobutyl, dodecyl, octadecyl, cyclobutyl and cyclohexyl groups) and alkenyl groups (for example, allyl and octenyl groups, etc.). Exemplary aryl groups include a phenyl group and a naphthyl group, etc. Typical heterocyclic residues are pyridinyl, quinolyl, thienyl, piperidyl and imidazolyl groups. Substituents which can be present in these aliphatic hydrocarbon residues, aryl groups and heterocyclic residues are halogen atoms and nitro, hydroxyl, carboxyl, amino, substituted amino, sulfo, alkyl, alkenyl, aryl, heterocyclic, alkoxy, aryloxy, arylthio, arylazo, acylamino, carbamoyl, ester, acyl, acyloxy, sulfonamido, sulfamoyl, sulfonyl and morpholino groups, etc.

$R_{10}$ represents an arylcarbonyl group, an alkanoyl group having 2 to 32, preferably 2 to 22, carbon atoms, an arylcarbamoyl group, an alkanecarbamoyl group having 2 to 32, preferably 2 to 22, carbon atoms, an alkoxycarbonyl group having 2 to 32, preferably 2 to 22, carbon atoms or an aryloxycarbonyl group, each of which may be substituted. Suitable substituents are alkoxy groups, alkoxycarbonyl groups, acylamino groups, alkylsulfamoyl groups, alkylsulfonamido groups, alkylsuccinimido groups, halogen atoms, nitro groups, carboxyl groups, cyano groups, alkyl groups and aryl groups, etc.

$R_{11}$ represents an arylcarbonyl group, an alkanoyl group having 2 to 32, preferably 2 to 22, carbon atoms, an arylcarbamoyl group, an alkanecarbamoyl group having 2 to 32, preferably 2 to 22, carbon atoms, an alkoxycarbonyl group having 2 to 32, preferably 2 to 22, carbon atoms, an aryloxycarbonyl group, an alkanesulfonyl group having 1 to 32, preferably 1 to 22, carbon atoms, an arylsulfonyl group, an aryl group or a 5-member or 6-member heterocyclic group (where the hetero atom is a nitrogen atom, an oxygen atom or a sulfur atom, such as a triazolyl group, an imidazolyl group, a phthalimido group, a succinimido group, a furyl group, a pyridyl group or a benzotriazolyl group), which may be substituted with substituents as described for $R_{10}$.

Representative atomic groups represented by X in the general formulae (III), (IV), (V) and (VI), which are particularly preferred, are the following groups because they have a high coupling rate. More specifically, examples of atomic groups bonding to the coupling position in the general formulae (VII) and (VIII) include a 2,4-dioxoimidazolidinyl group, a 3,5-dioxotriazolidinyl-4-yl group, a 2,4-dioxoxazolidinyl group, an imidazolyl group, a pyrazolyl group, a triazolyl group, a benzotriazolyl group, a phenoxy group, an aryl group, a tetrazolylthio group, an alkylthio group, an alkoxy group and an acyloxy group. Examples of preferred atomic groups bonding to the coupling position in the general formulae (IX), (X) and (XI) include an imidazolyl group, a pyrazolyl group, a triazolyl group, a benzotriazolyl group, an arylthio group, a tetrazolylthio group, a phenoxy group, an alkoxy group, an acyloxy group, an alkylthio group and an arylazo group. Examples of preferred atomic groups bonding to the coupling position in the general formulae (XII), (XIII) and (XIV) include an alkoxy group, a phenoxy group, an arylazo group, an arylthio group, a tetrazolylthio group, an acyloxy group and an alkylthio group. Examples of preferred atomic groups bonding to the coupling position in the general formulae (XV) and (XVI) include a tetrazolylthio group, a benzotriazolyl group, a pyrazolyl group, an arylthio group, an arylazo group and a phenoxy group. These releasing groups may be substituted with substituents as described as substituents for X in the general formulae (III), (IV), (V) and (VI).

Examples of compounds of the present invention are described below but the present invention is not to be construed as being limited to compounds.

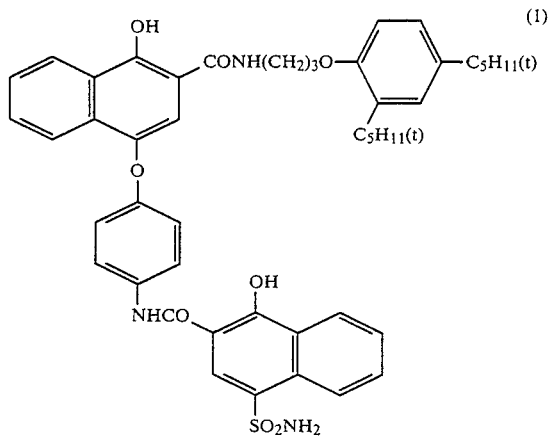

(1)

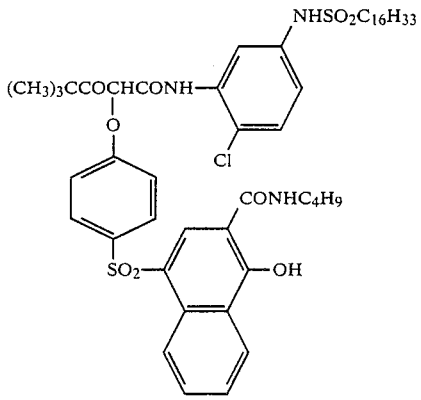

(2)

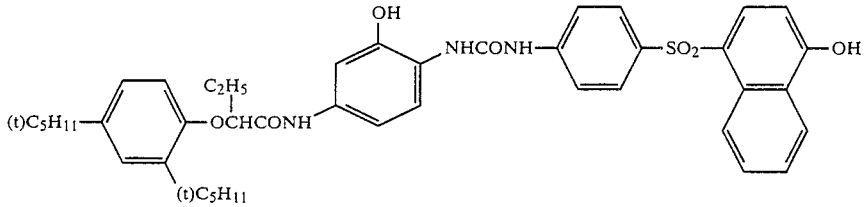

(3)

-continued
(4)
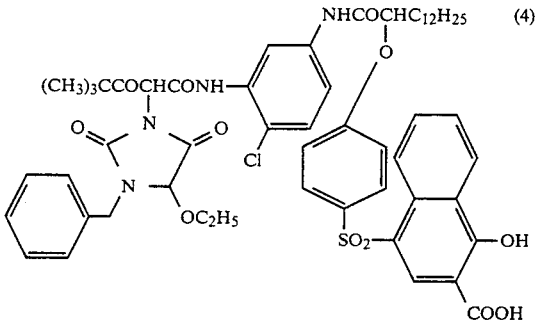
(5)
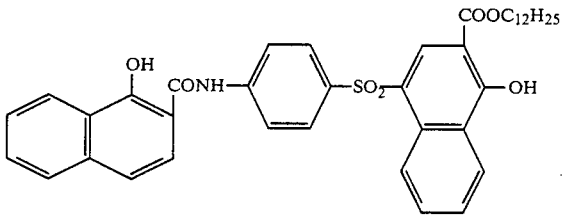
(6)
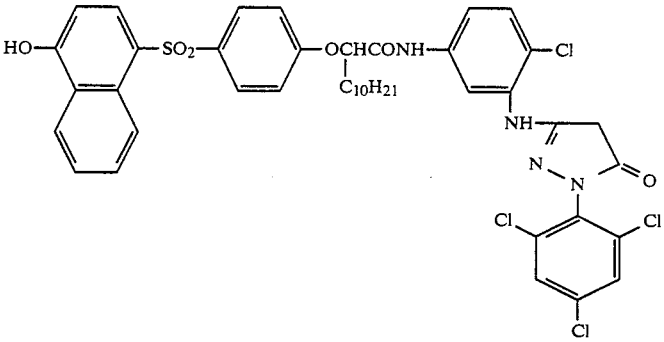
(7)
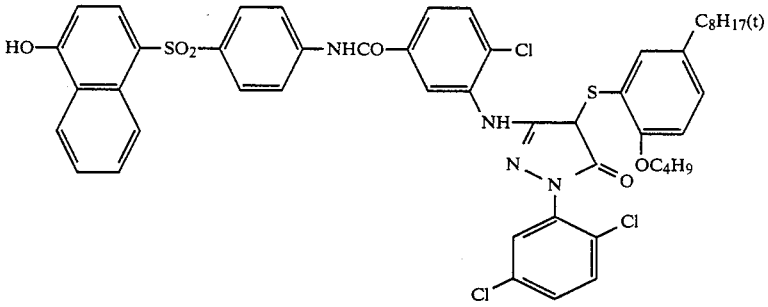
(8)
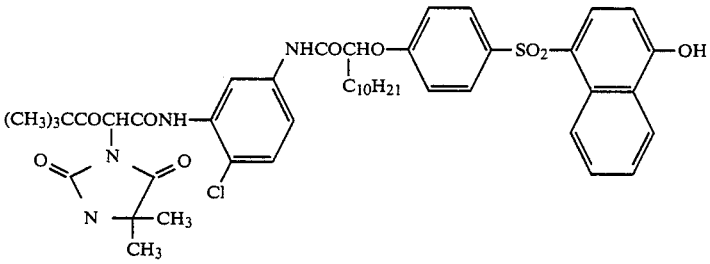
(9)
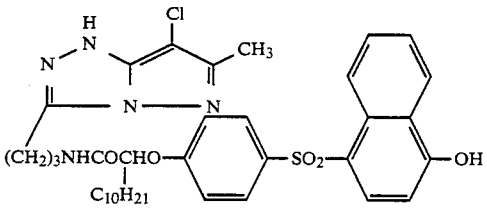
(10)
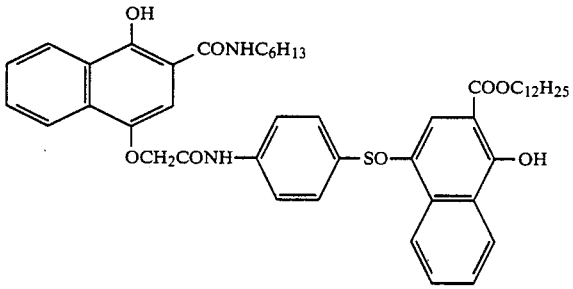

-continued
(11)
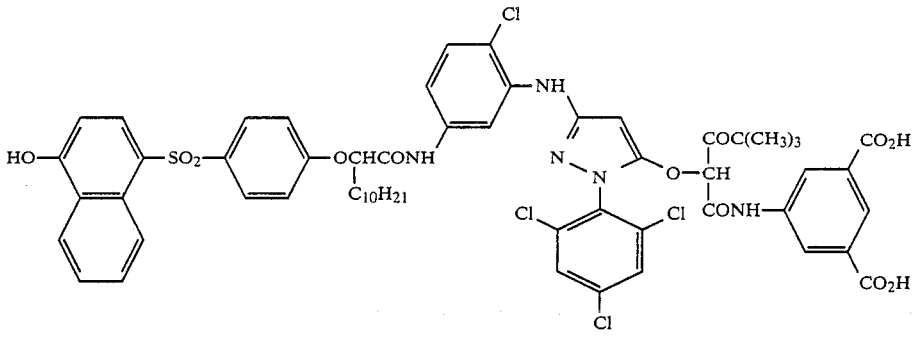
(12)
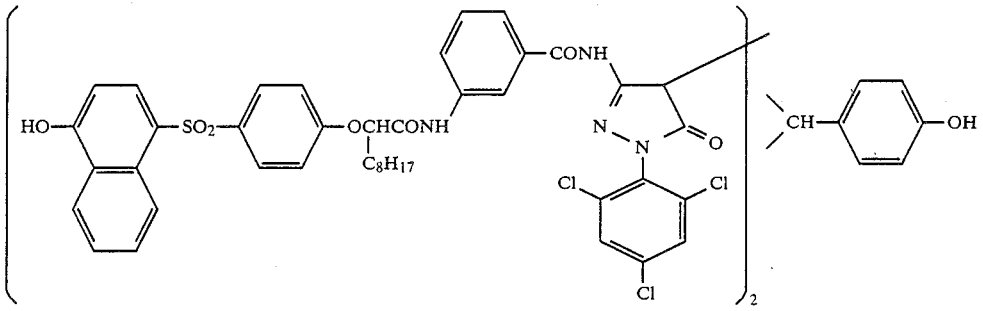
(13)
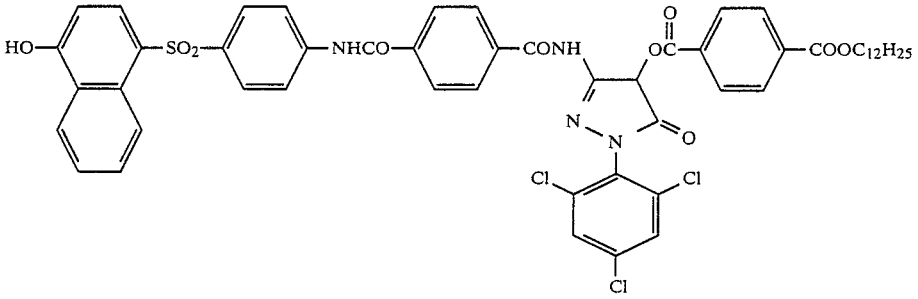
(14)
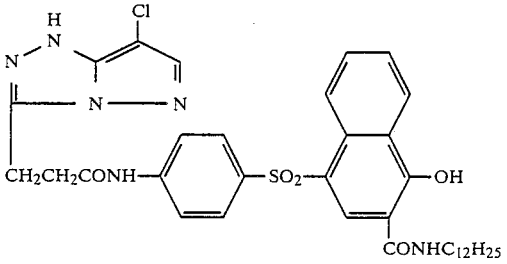
(15)
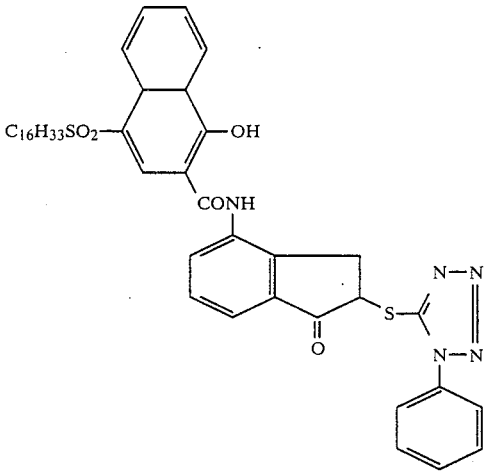

-continued
(16)
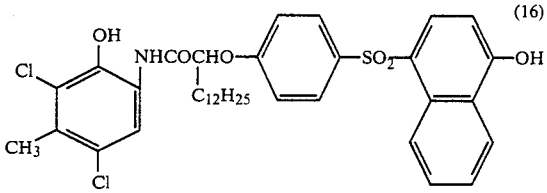
(17)
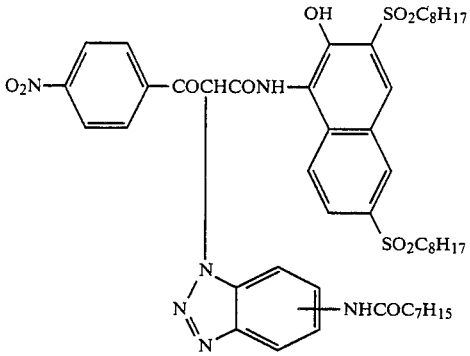
(18)
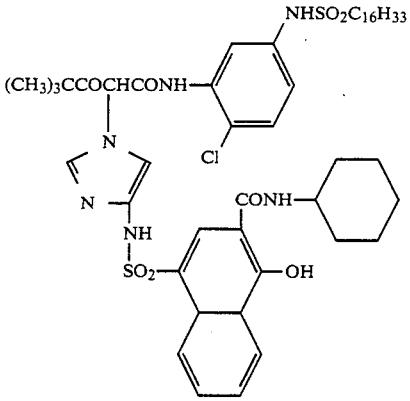
(19)
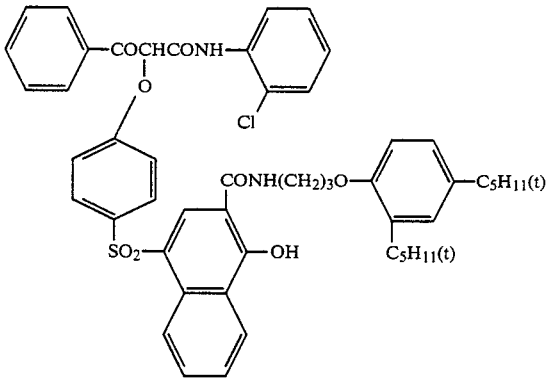
(20)
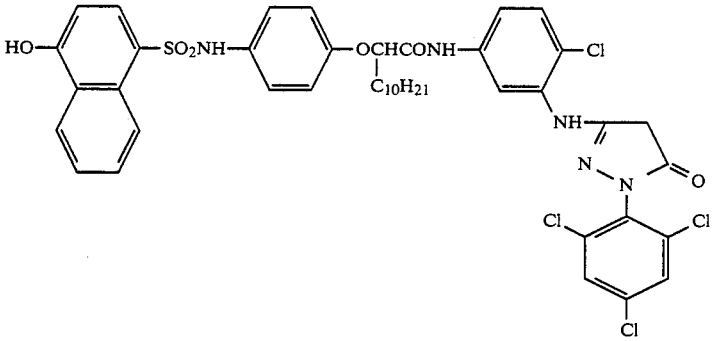
(21)
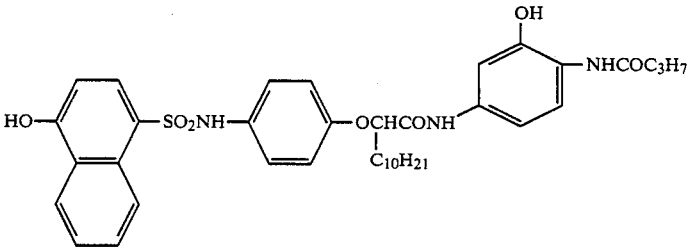

-continued
(22)
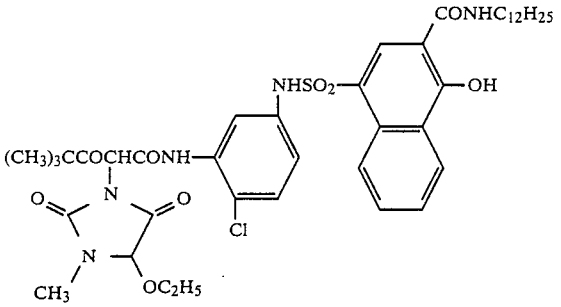
(23)
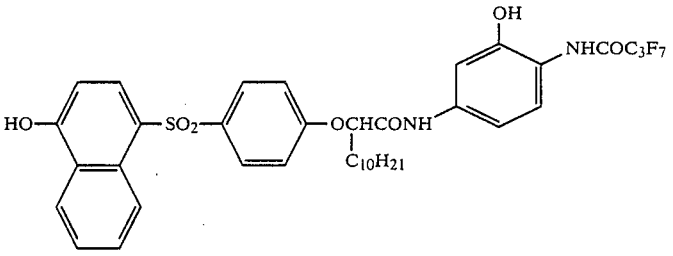
(24)
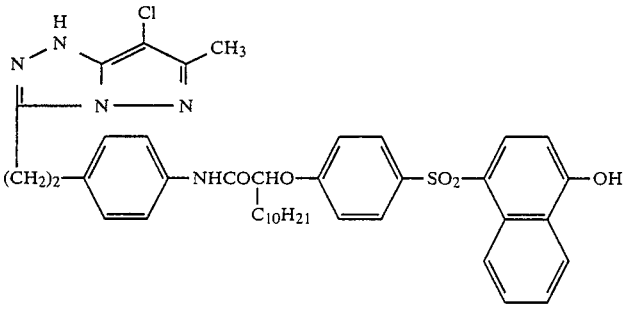
(25)
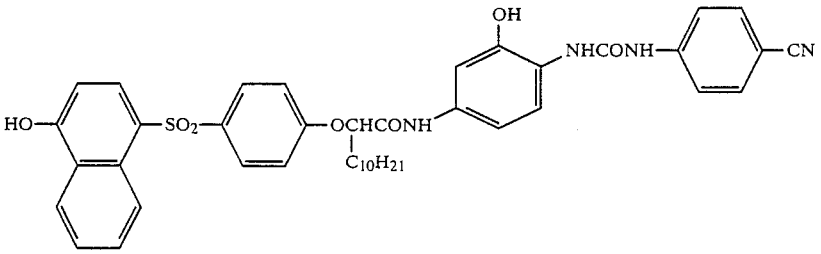
(26)
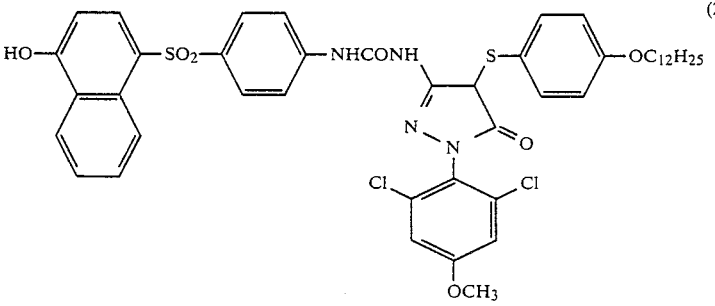
(27)
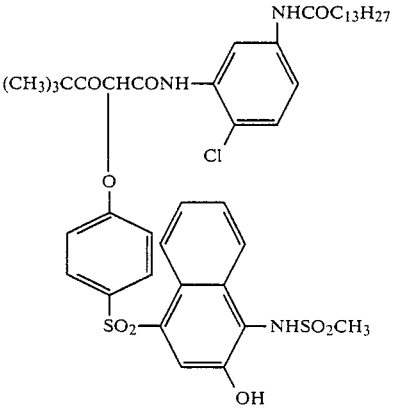

-continued
(28)
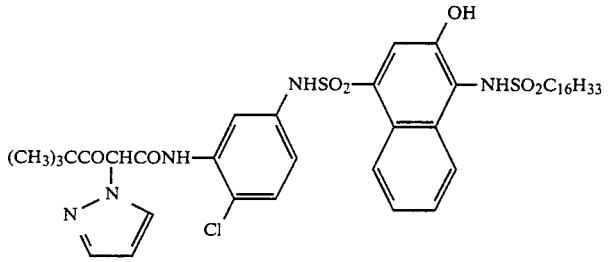
(29)
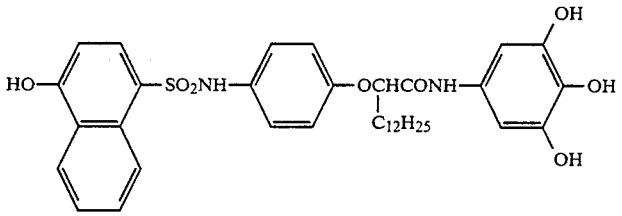
(30)
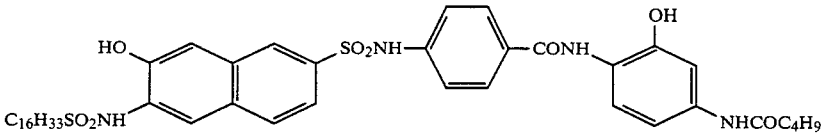
(31)
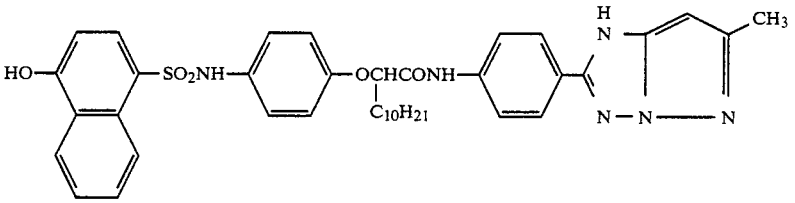
(32)
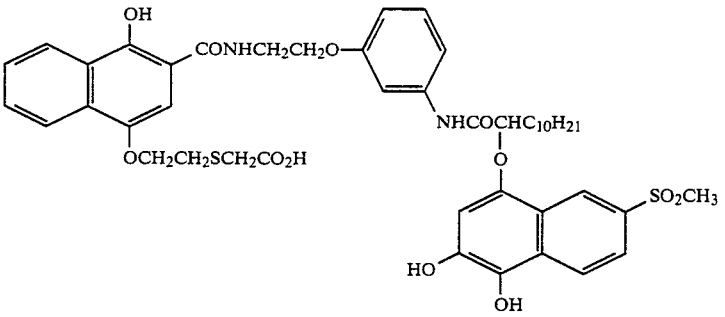
(33)
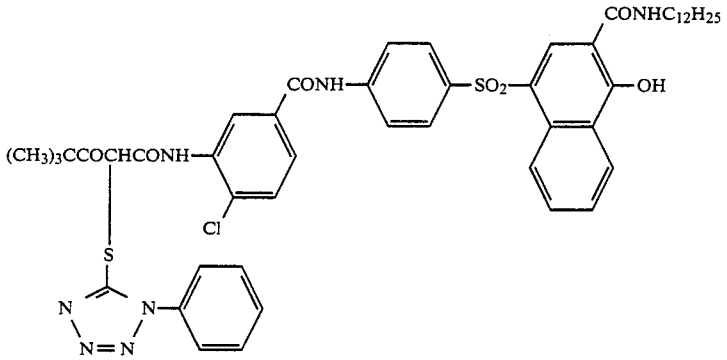

-continued (34)

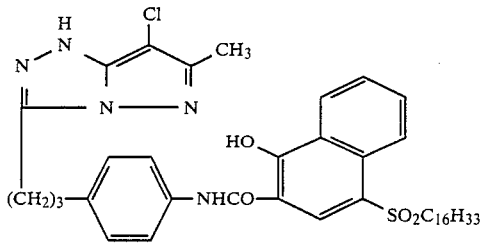

(35)

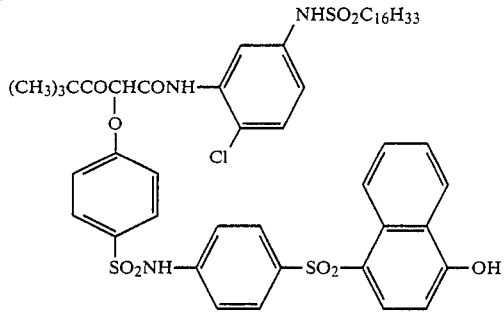

(36)

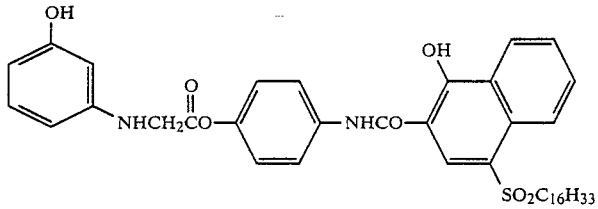

Couplers of the present invention can be synthesized by using known processes. The synthesis of 2-equivalent couplers is advantageously carried out by introducing an atomic group which becomes a releasing group after the coupler nucleus is synthesized. For example, in most yellow couplers and magenta couplers, 2-equivalent couplers are obtained by reacting a compound which becomes a releasing group with a 4-equivalent coupler in the presence or absence of a base after halogenation of the active position of the 4-equivalent coupler. In cyan couplers and some magenta couplers, ether-releasing 2-equivalent couplers are obtained by reacting a halide of the compound which becomes a releasing group with a coupler having a hydroxyl group at the active position in a presence of a base. Further, synthesis of thioether releasing 2-equivalent couplers can be carried out generally by a process which comprises reacting sulfenyl chloride with a 4-equivalent coupler. Further, in some couplers, after synthesis of the base portion of the coupler, an active functional group such as an amino group, etc., is formed by reduction, etc., to combine with a ballast group. In some magenta couplers, a process is used which comprises introducing a releasing group before formation of the pyrazolone ring and thereafter forming the pyrazolone ring with a hydrazine compound.

The processes for introducing a releasing group into the coupling position of a coupler are those described in U.S. Pat. Nos. 3,408,194, 3,447,928, 3,730,722, 3,227,554, 3,476,563, 3,311,476, 3,462,270, 3,419,391, 3,876,428, 3,458,315 and 3,737,316, and Japanese Patent Application (OPI) Nos. 10728/75, 29432/73, 73147/73, 122335/74, 17438/76, 20826/76, 135310/75, 117422/75, 18364/83, 26034/76 and 21828/76, etc.

The following examples of the syntheses of couplers according to the present invention are given to further illustrate more specifically their synthesis. Unless otherwise indicated, all parts, percents, ratios and the like are by weight.

SYNTHESIS EXAMPLE (1)

Synthesis of Coupler (1)

28.4 g of 4-(4-aminophenoxy)-2-[3-(2,4-di-tert-amylphenoxy)propylcarbamoyl]naphthol (synthesized by a process described in U.S. Pat. No. 3,476,563) and 13.4 g of 1-hydroxy-4-sulfamoyl-2-naphthoic acid were blended with 100 ml of N,N-dimethylformamide. To the resulting solution, a solution prepared by dissolving 10.3 g of N,N'-dicyclohexylcarbodiimide in 30 ml of ethyl acetate was added dropwise. After reaction for 2 hours, the crystals precipitated were filtered out, and the filtrate was added to 500 ml of water. The mixture was vigorously stirred to solidify. The crystals were filtered off and dried to obtain 41 g of the desired coupler.

SYNTHESIS EXAMPLE (2)

Synthesis of Coupler (2)

17.8 g of α-chloro-α-pivaloyl-2-chloro-5-hexadecanesulfonamidoacetanilide, 12 g of N-butyl-4-(4-hydroxyphenylsulfonyl)-1-hydroxy-2-naphthamide and 60 g of triethylamine were blended with 200 ml of acetonitrile, and the resulting mixture was refluxed with heating for 3 hours. After cooling to room temperature, the mixture was added to 500 ml of water and extracted with ethyl acetate. After washing with 1N dilute hydrochloric acid, water washing was repeated until the wash became neutral. The oil layer was separated and dried over anhydrous sodium sulfate, and the solvent was distilled away. To the residue, diethyl ether was added for crystallization. Thus, 21 g of the desired coupler was obtained.

SYNTHESIS EXAMPLE (3)

Synthesis of Coupler (3)

12.6 g of 2-amino-5-[2-(2,4-di-tert-amylphenoxy)-butyramido]phenol, 12.6 g of 4-(4-phenoxycarbonylaminophenylsulfonyl)-1-naphthol and 0.5 g of imidazole were mixed with 200 ml of toluene, and the resulting mixture was refluxed with heating for 8 hours. After cooling to room temperature, 100 ml of hexane was added to precipitate crystals. The crystals were filtered off to obtain 11.3 g of the desired coupler.

The amount of the coupler of the present invention which can be used is not limited, but a generally preferred is about 1 g to 1500 g per mole of silver halide in the emulsion layer.

The use of the couplers in the present invention are described below.

The compounds of the present invention can be introduced into a gelatin-silver halide emulsion or a hydrophilic colloid using processes for adding or dispersing couplers in an emulsion. For example, a process wherein couplers are dispersed by blending them with a high boiling point organic solvent such as dibutyl phthalate, tricresyl phosphate, wax, higher fatty acid or ester, etc., for example, a process described in U.S. Pat. Nos. 2,304,939 or 2,322,027 can be used. Further, a process wherein couplers are dispersed by blending them with a low boiling point organic solvent or a water soluble organic solvent can be used. In addition, a process wherein couplers are dispersed using a high boiling point organic solvent together with a low boiling point organic solvent or a water soluble organic solvent, for example, a process described in U.S. Pat. No. 2,801,170, 2,801,171 or 2,949,360, etc. can be used. Where couplers have a sufficiently low melting point (for example, less than 75° C.), a process wherein the couplers are dispersed alone or together with other couplers, for example, a colored coupler or an uncolored coupler, etc., for example, a process described in German Patent No. 1,143,707 can be used.

Anionic surface active agents conventionally used (for example, sodium alkylbenzenesulfonate, sodium dioctylsulfosuccinate, sodium dodecylsulfate, sodium alkylnaphthalenesulfonate and Fischer type couplers, etc.), ampholytic surface active agents (for example, N-tetradecyl-N,N-dipolyethylene-α-betaine, etc.) and nonionic surface active agents (for example, sorbitan monolaurate, etc.) can be used as dispersing assistants.

Known couplers can be used in combination with the couplers of the present invention and are described below.

Examples of magenta couplers which can be used include those described in U.S. Pat. Nos. 2,600,788, 2,983,608, 3,062,653, 3,127,269, 3,311,476, 3,419,391, 3,519,429, 4,367,282, 3,558,319, 3,582,322, 4,366,237, 3,615,506, 4,351,897, 3,834,908, 4,338,393, 3,891,445 and 4,241,168, German Patent No. 1,810,464, German Patent Application (OLS) Nos. 2,408,665, 2,417,945, 2,418,959 and 2,424,467, Japanese Patent Publication No. 6031/65 and Japanese Patent Application (OPI) Nos. 20826/76, 58922/77, 129538/74, 74027/74, 159336/75, 42121/77, 74028/74, 60233/75, 26541/76 and 55122/78, etc.

Examples of yellow couplers include those described in U.S. Pat. Nos. 2,875,057, 3,265,506, 3,408,194, 3,551,155, 3,582,322, 3,725,072, 4,356,258 and 3,891,445. German Patent No. 1,547,868, German Patent Application (OLS) Nos. 2,219,917, 2,261,361 and 2,414,006, British Patent No. 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77, etc.

Examples of cyan couplers include those described in U.S. Pat. Nos. 2,369,929, 4,362,810, 2,434,272, 4,368,257, 2,474,293, 2,521,908, 2,895,826, 4,341,864, 3,034,892, 3,311,476, 3,458,315, 3,476,563, 3,583,971, 3,591,383, 4,333,999, 3,767,411, 4,342,825, 4,004,929 and 4,345,025, German Patent Application (OLS) Nos. 2,414,830 and 2,454,329, and Japanese Patent Application (OPI) Nos. 59838/73, 26034/76, 5055/73, 146828/76, 69624/77 and 90932/77, etc.

Those colored couplers described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959 can be used.

As DIR couplers, it is possible to use those described in, for example, U.S. Pat. Nos. 3,227,554, 3,617,291, 3,701,783, 4,355,100, 3,790,384, 4,248,962 and 3,632,345, German Patent Application (OLS) Nos. 2,414,006, 3,209,486, 2,454,301 and 2,454,329, British Patent No. 953,454, Japanese Patent Application (OPI) Nos. 69624/77 and 122335/74, and Japanese Patent Publication No. 16141/76.

The light-sensitive materials may contain compounds which release a development inhibitor by development, other than DIR couplers. For example, it is possible to use compounds described in U.S. Pat. Nos. 3,297,445 and 3,379,529, German Patent Application (OLS) No. 2,417,914 and Japanese Patent Application (OPI) Nos. 15271/77 and 9116/78.

Suitable high boiling point organic solvents are described in, for example, U.S. Pat. Nos. 2,322,027, 2,533,514 and 2,835,579, Japanese Patent Publication No. 23233/71, U.S. Pat. No. 3,287,134, British Patent No. 958,441, Japanese Patent Application (OPI) No. 1031/72, British Patent No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, German Patent Application (OLS) No. 2,538,889, Japanese Patent Application (OPI) No. 27921/76, 27922/76, 26035/76, 26036/76 and 62632/75, Japanese Patent Publication No. 29461/74, U.S. Pat. Nos. 3,936,303 and 3,748,141, and Japanese Patent Application (OPI) No. 1521/78, etc.

Gelatin is advantageously used as a binder or a protective colloid for photographic emulsions, but other hydrophilic colloids can be used.

For example, it is possible to use proteins such as gelatin derivatives, graft polymers of gelatin with other polymers, albumin or casein, etc.; saccharose derivatives such as cellulose derivatives such as hydroxyethyl cellulose, carboxymethyl cellulose or cellulose sulfate, etc., sodium alginate or starch derivatives, etc.; and various synthetic high molecular weight substances such as homo- or copolymers, for example, polyvinyl alcohol, polyvinyl alcohol partial acetal, poly-N-vinylpyrrolidone, polyacrylic acid, polymethacrylic acid, polyacrylamide, polyvinylimmidazole or polyvinyl pyrazole, etc.

Not only lime processed gelatin but also acid treated gelatin and enzyme treated gelatin described in *Bull. Soc. Sci. Phot. Japan,* No. 16, page 30 (1966) may be used as the gelatin. Further, hydrolyzed products or enzymatic decomposition products of gelatin can be used. Suitable gelatin derivatives which can be used are those which are obtained by reacting gelatin with various compounds, for example, acid halides, acid anhydrides, isocyanates, bromoacetic acid, alkanesultones, vinylsulfonamides, maleinimides, polyalkylene oxides or epoxy compounds, etc.

Any of silver bromide, silver iodobromide, silver iodochlorobromide, silver chlorobromide and silver chloride may be used as the silver halide in the photographic emulsions used in the present invention.

It is preferred for the average grain size (which means the grain size obtained by taking an average of volume corresponding to a sphere, in the case of spherical or nearly spherical grains, regular grains such as cube or octahedron, etc. and plate like grains, etc.) of silver halide grains in the photographic emulsions is about 5μ or less and, preferably 3μ or less.

The distribution of grain size of the silver halide grains may be broad or may be narrow.

The silver halide grains in the photographic emulsions of this invention may have a regular crystal form such as a cube or an octahedron. Further, they may have an irregular crystal form such as that of a sphere or table, etc. or may have a complex crystal form. A mixture composed of grains having various crystal forms may be used.

The interior and the surface layer of the silver halide grains may have each a different phase, or the silver halide grains may be uniform. Further, grains wherein latent images are chiefly formed on the surface or grains wherein the latent images are chiefly formed in the interior of the grains may be used.

The photographic emulsions used in the present invention can be prepared by processes described in P. Glafkides, *Chimie et Physique Photographique* (published by Pual Montel Co., 1967), G. F. Duffin, *Photographic Emulsion Chemistry* (published by The Focal Press, 1966) and V. L. Zelikman et al, *Making and Coating Photographic Emulsion* (published by The Focal Press, 1964), etc. Namely, any of an acid process, a neutral process and an ammonia process may be used. Further, a one-side mixing process, a simultaneous mixing process and a combination of these processes may be used to react soluble silver salts and soluble halogen salts.

A process of forming grains in the presence of excess silver ion (the so-called back-mixing process) can be used. A process in which the liquid in which silver halide is formed is kept at a constant pAg, namely, the so-called controlled double jet process is a type of the simultaneous mixing process which can be used. According to this process, silver halide emulsions having a regular crystal form and a uniform grain size are obtained.

A mixture of two or more kinds of silver halide emulsions prepared respectively may be used if desired.

Formation of silver halide grains or physical ageing of them may be carried out in the presence of cadmium salts, zinc salts, lead salts, thallium salts, iridium salts or complex salts thereof, rhodium salts or complex salts thereof or iron salts or complex salts thereof, etc.

In order to remove soluble salts from the emulsion after formation of precipitates or physical ageing, a noodle water washing process in which gelatin is gelatinized may be used. Further, a precipitation process utilizing inorganic salts, anionic surface active agents, anionic polymers (for example, polystyrenesulfonic acid) or gelatin derivatives (for example, acylated gelatine or carbamoylated gelatine, etc.) (flocculation process) may be used.

Silver halide emulsions are generally chemically sensitized. In order to carry out chemical sensitization, processes described in H. Friezer, ed., *Die Grundlagen der Photographischen Prozesse mit Silberhalogeniden* (Akademische Verlagsgesellschaft, 1968), pages 675–734 can be used.

Namely, a sulfur sensitization process using sulfur-containing compounds capable of reacting with active gelatin or silver (for example, thiosulfates, thioureas, mercapto compounds or rhodanines), a reduction sensitization process using reducing substances (for example, stannous salts, amines, hydrazine derivatives, formamidinesulfinic acid, or silane compounds), a noble metal sensitization process using noble metal compounds (for example, gold complex salts and complex salts of metal of group VIII in the periodic table such as Pt, Ir or Pd, etc.) or a combination thereof can be used.

Examples of sulfur sensitization processes are described in U.S. Pat. Nos. 1,574,944, 2,410,689, 2,278,947, 2,728,668 and 3,656,955, etc., examples of reduction sensitization processes are described in U.S. Pat. Nos. 2,983,609, 2,419,974 and 4,054,458, etc., and examples of the noble metal sensitization processes are described in U.S. Pat. Nos. 2,399,083 and 2,448,060 and British Pat. No. 618,061, etc.

Various compounds for the purpose of preventing fogging in the step of producing light-sensitive materials, during storage thereof or during photographic processing, or or stabilizing photographic properties can be added to photographic emulsions used in the present invention. Namely, it is possible to add many compounds known as antifoggants or stabilizers, such as azoles, for example, benzothiazolium salts, nitroimidazoles, triazoles, benzotriazoles and benzimidazoles (particularly, nitro- or halogen substituted substances); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above described heterocyclic mercapto compounds which further include water solubilitizing groups such as carboxyl groups or sulfonic acid groups, etc.; thioketo compounds, for example, oxazolinethione; azaindenes, for example, tetrazaindenes (particularly, 4-hydroxy-(1,3,3a,7)tetrazaindenes); benzenethiosulfonic acids; and benzenesulfinic acid; etc.

The photographic emulsion layers or other hydrophilic colloid layers in the light-sensitive materials produced according to the present invention may contain various kinds of surface active agents for various purposes such as coating aids, prevention of electrostatic charging, improvement of lubricating property, emulsification or dispersion, prevention of adhesion or improvement of photographic properties (for example, acceleration of development, hard toning or sensitization), etc.

For example, nonionic surface active agents such as saponin (steriod type), alkylene oxide derivatives (for example, polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamine or amides, and polyethylene oxide addition products of silicone), glycidol derivatives (for example, alkenylsuccinic acid polyglyceride and alkylphenol polyglyceride), polyhydric alcohol aliphatic acid esters, or saccharose alkyl esters, etc.; anionic surface active agents containing acid groups such as carboxyl group, sulfo group, phospho group, sulfuric acid ester group or phosphoric acid group, etc., such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters sulfoalkylpolyoxyethylene alkylphenyl ethers and polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, or amine oxides, etc.; and cationic surface active agents such as alkylamines, aliphatic or aromatic quaternary ammonium salts, heterocyclic quaternary ammonium salts such as pyridinium salts or imidazolium salts, etc., and aliphatic or heterocyclic phosphonium or sulfonium salts, etc., can be used.

The photographic emulsion layers in the photographic light-sensitive materials produced according to the present invention may contain, for example, polyalkylene oxides or derivatives thereof such as ether, ester or amine, etc., thioether compounds, thiomorpholines, quaternary ammonium salt compounds, urethane derivatives, urea derivatives, imidazole derivatives and 3-pyrazolidones, etc., for the purpose of increasing the sensitivity, improving contrast or accelerating development. For example, those compounds described in U.S. Pat. Nos. 2,400,532, 2,423,549, 2,716,062, 3,617,280, 3,772,021 and 3,808,003 and British Pat. No. 1,488,991, etc., can be used.

The light-sensitive materials produced according to the present invention, it is possible to utilize known processes and known processing solutions, as described in, for example, *Research Disclosure,* No. 176, pages 28–30 (RD-17643). This photographic processing may be any photographic processing for forming silver images (black-white photographic processing) and photographic processing for forming dye images (color photographic processing) according to the purpose. The processing temperature is generally within a range of about 18° C. to about 50° C., but a temperature lower than about 18° C. or a temperature higher than about 50° C. may be used. The light-sensitive materials of the present invention are particularly suitable for high temperature processing at about 30° C. or more.

Conventional processes can be employed to form dye images. For example, it is possible to use a negative-positive process (described in *Journal of the Society of Motion Picture and Television Engineers,* Vol 61 (1953), pages 667–701); a color reversal process which comprises forming negative silver images by development with a developing solution containing a black-white developing agent, carrying out at least one uniform exposure to light or another suitable fogging treatment, and subsequently carrying out color development to form dye positive images; and a silver dye bleaching process which comprises exposing photographic emulsion layers containing dyes to light and developing to form silver images and bleaching the dyes using the silver images as a bleaching catalyst.

The color developing solution generally comprises an alkaline aqueous solution containing a color developing agent. Known primary aromatic amine developers, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3methyl-N-ethyl-N-β-methoxyethylaniline, etc.,). can be used as the developing agent.

In addition, substances described in L. F. A. Mason, *Photographic Processing Chemistry,* (Focal Press, 1966) pages 226–229, U.S. Pat. Nos. 2,193,015 and 2,592,364 and Japanese Patent Application (OPI) No. 64933/ 73, etc., can be used.

The color developing solution may contain pH buffer agents, development inhibitors or antifogging agents, etc. Further, if desired, the solution may contain water softeners, preservatives, organic solvents, development accelerators, dye forming couplers, competing couplers, fogging agents, auxiliary developing agents, viscosity increasing agents, polycarboxylic acid type chelating agents and antioxidants, etc.

Examples of these additives are described in *Research Disclosure* (RD-17643) and U.S. Pat. No 4,083,723 and German Patent Application (OLS) No. 2,622,950, etc.

The photographic emulsion layers after color development are generally bleached. The bleaching processing may be carried out simultaneously with the fixing processing or may be carried out separately. Compounds of polyvalent metals such as iron (III), cobalt (III), chromium (VI) or copper (II), etc., peracids, quinones and nitroso compounds can be used as bleaching agents.

For example, ferricyanides; bichromates; organic complex salts of iron (III) or cobalt (III), for example, complex salts of organic acids such as aminopolycarboxylic acids, for example, ethylenediaminetetraacetic acid, nitrilotriacetic acid and 1,3-diamino-2-propanoltetraacetic acid, etc., citric acid, tartaric acid or malic acid, etc.; persulfates, permanganates and nitrosophenol, etc., can be used. Of these compounds, potassium ferricyanide, ethylenediaminetetraacetato iron (III) sodium and ethylenediaminetetraacetato iron (III) ammonium are particularly useful. Ethylenediaminetetraacetato iron (III) complex salts are useful in both the bleaching solution and the mono-bath bleach-fixing solution.

Various additives including bleach accelerating agents described in U.S. Pat. Nos. 3,042,520 and 3,241,966 and Japanese Patent Publication Nos. 8506/70 and 8836/70, etc., and thiol compounds described in Japanese Patent Application (OPI) No. 65732/78 can be added to the bleaching solution or the bleach-fixing solution.

The light-sensitive materials produced according to the present invention may be processed with a developing solution which is supplemented or controlled by the methods described in Japanese Patent Application (OPI) Nos. 84636/76, 119934/77, 46732/78, 9626/79, 19741/79, 37731/79, 1048/81, 1049/81 and 27142/81.

The bleach-fixing solution used for the light-sensitive materials produced according to the present invention may be that which is subjected to regeneration using the processes described in Japanese Patent Application (OPI) Nos. 781/71, 49437/73, 18191/73, 145231/75, 18541/76, 19535/76 and 144620/76, and Japanese Patent Publication No. 23198/76.

The photographic emulsion layers and other hydrophilic colloid layers of the photographic light-sensitive materials produced of the present invention may contain dispersions of water insoluble or poorly soluble synthetic polymers, for the purpose of improving dimensional stability. For example, polymers composed of one or more monomer components selected from alkyl acrylates (methacrylates), alkoxyalkyl acrylates (methacrylates), glycidyl acrylates (methacrylates), acrylamide (methacrylamide), vinyl esters (for example, vinyl acetate), acrylonitrile, olefins and styrenes, etc., or polymers composed of the above described monomer components and acrylic acid, methacrylic acid, α,β-unsaturated dicarboxylic acids, hydroxyalkyl acrylates (methacrylates), sulfoalkyl acrylates (methacrylates) or styrenesulfonic acid, etc. as another monomer component can be used. For example, it is possible to use polymers described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373.

The photographic emulsions used in the present invention may be spectrally sensitized with methine dyes or other dyes, if desired.

Examples of useful sensitizing dyes include those described in German Patent No. 929,080, U.S. Pat. Nos. 2,493,748, 2,503,776, 2,519,001, 2,912,329, 3,656,959, 3,672,897 and 4,025,349, British Pat. No. 1,242,588, and Japanese Patent Publication No. 14030/ 69.

These sensitizing dyes may be used alone, or combinations thereof can be used if desired. Combinations of the sensitizing dyes are often used for the purpose of supersensitization. Examples of suitable combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, and Japanese Patent Application (OPI) Nos. 110618/77 and 109925/77.

The photographic emulsion layers and other layers in the photographic light-sensitive materials of the present invention are applied to flexible supports conventionally used for photographic light-sensitive materials, such as synthetic resin films, paper or cloths, etc., or rigid supports such as glass, porcelain or metal, etc., Useful flexible supports include films composed of semi-synthetic or synthetic polymers such as cellulose nitrate, cellulose acetate, cellulose acetate butyrate, polystyrene, polyvinyl chloride, polyethylene terephthalate or polycarbonate, etc., and coated or laminated papers obtained by applying a baryta layer or $\alpha$-olefin polymer (for example, polyethylene, polypropylene or ethylene/butene copolymer), etc. The supports may be colored with dyes or pigments. The supports may also be blacked for the purpose of shielding light. The surface of these supports is generally subjected to an undercoating treatment in order to improve adhesion to photographic emulsion layers, etc. The surface of the supports may be subjected to a corona discharging, application of ultraviolet light or a flame treatment prior to or after the undercoating treatment.

The phtographic emulsion layers and other hydrophilic colloid layers of the photographic light-sensitive materials of the present invention can be applied to the support or another layer using known coating methods. Coating can be carried out by the immersion coating method, the roller coating method, the curtain coating method or the extrusion coating method, etc. The methods described in U.S. Pat. Nos. 2,681,294, 2,761,791 and 3,526,528 are advantageous methods.

The present invention is applicable to multilayer color photographic materials having at least two layers, each with a different spectral sensitivity, on the support. Multilayer natural color photographic materials generally include at least one red-sensitive silver halide emulsion layer, at least one green-sensitive silver halide emulsion layer and at least one blue-sensitive silver halide emulsion layer on the support. The order of these layers can be suitably selected as occasion demands. In general, the red-sensitive emulsion layer contains a cyan coupler, the green-sensitive emulsion layer contains a magenta coupler and the blue-sensitive emulsion layer contains a yellow coupler, but, if desired, other combinations can be utilized.

Exposure to light for obtaining photographic images may be carried out in any conventional manner. Namely, various kinds of known light sources, such as natural light (sunlight), tungsten lamps, fluorescent lamps, mercury lamps, xenon arc lamps, carbon arc lamps, xenon flash lamps or cathode ray tube flying spot, etc., can be used. For exposure to light, not only is an exposure time of 1/1000 second to 1 second which is utilized for conventional cameras, but also an exposure time shorter than 1/1000 second, for example, $1/10^4$ to $1/10^6$ second in case of using a xenon flash lamp or a cathode ray tube, can be used and an exposure time longer than 1 second can be used, also. If desired, the spectral composition of the light used for exposure can be controlled with color filters. Laser rays also can be used for exposure. Further, the exposure may be carried out by light emitted from fluophores excited by electron beams, X-rays, $\gamma$-rays or $\alpha$-rays, etc.

The photographic emulsion layers and other hydrophilic colloid layers of the light-sensitive materials produced according to the present invention may contain whitening agents such as stilbene type, triazine type, oxazole type or coumarin type whitening agents. These agents may be soluble in water, or water insoluble whitening agents may be used as a dispersion.

The photographic emulsion layers and other hydrophilic colloid layers of the photographic light-sensitive materials produced according to the present invention may contain inorganic or organic hardening agents. For example, chromium salts (chromium alum and chromium acetate, etc.), aldehydes (formaldehyde, glyoxal and glutaraldehyde, etc.), N-methylol compounds (dimethylolurea and methyloldimethylhydantoin, etc.), dioxane derivatives (2,3-dihydroxydioxane, etc.), active vinyl compounds (1,3,5-triacryloyl-hexahydro-s-triazine and 1,3-bis(vinylsulfonyl)-2-propanol, etc.), active halogen compounds (2,4-dichloro-6-hydroxy-s-triazine, etc.), and mucohalogenic acids (mucochloric acid and mucophenoxychloric acid, etc.), etc., may be used alone or as a combination thereof.

When dyes or ultraviolet light absorbing agents, etc., are present in the hydrophilic colloid layers of the light-sensitive materials produced according to the present invention, they may be mordanted by cationic polymers, etc. For example, the polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362, and Japanese Patent Application (OPI) Nos. 47624/75 and 71332/75, etc., can be used.

The light-sensitive materials produced according to the present invention may contain hydroquinone derivatives, aminophenol derivatives, gallic acid derivatives or ascorbic acid derivatives, etc., as anti-color-fogging agents.

The hydrophilic colloid layers of the light-sensitive materials produced according to the present invention may contain ultraviolet light absorbing agents, if desired. For example, benzotriazole compounds substituted with aryl groups, 4-thiazolidone compounds, benzophenone compounds, cinnamic acid ester compounds, butadiene compounds, benzoxazole compounds and ultraviolet light absorbing polymers, etc., can be used. These ultraviolet light absorbing agents may be fixed in the above described hydrophilic colloid layers.

Embodiments and characteristics of the present invention are illustrated with reference to the following examples, but the scope of the present invention is not to be construed as being limited thereby. Again, unless otherwise indicated, all parts, percents, ratios and the like are by weight.

EXAMPLE 1

A coupler emulsified dispersion was obtained by dissolving 10 g of a coupler (1) of the present invention in a mixture of 5 ml of dibutyl phthalate and 10 ml of ethyl acetate with heating, blending the resulting solution with 100 ml of a 10% aqueous solution of gelatin containing 0.1 g of sodium dodecylbenzenesulfonate, and stirring at 50° C. using a homogenizer revolving at a high rate. The resulting dispersion was blended with 150 g of a silver chlorobromide emulsion. To the resulting mixture, 15 ml of a 2% aqueous solution of 2-hydroxy-4,6-dichloro-s-triazine Na salt and 6 ml of a 5% aqueous solution of saponin were added. The mixture was applied to a cellulose acetate film to result in a silver coating amount of 1 g/m$^2$, and a gelatin protective layer having a dry film thickness of 1$\mu$ was applied to the resulting layer to produce Sample A. Samples B to R as described in Table 1 below were produced in the same manner as described for Sample A, except that the molar amount of the coupler and the silver content were controlled so as to be equal to those in Sample A.

After Samples A–R were exposed stepwise to light for sensitometry, the samples were subjected to the following development processing.

| Process | Temperature | Time |
|---|---|---|
| Color Development | 38° C. | 3 minutes |
| Water Wash | " | 1 minute |
| Blixing | " | 1 minute and 30 seconds |
| Water Wash | " | 1 minute |

The compositions of the color developers solutions used were as follows.

| | Color Developer | | |
|---|---|---|---|
| | CD-1 | CD-2 | CD-3 |
| Benzyl Alcohol | — | — | 15 ml |
| Diethylene Glycol | — | — | 8 ml |
| Developing Agent | 4-Amino-3-methyl-N—ethyl-N—$\beta$-hydroxyethyl-aniline sulfate 3.5 g | 4-Amino-3-methyl-N—ethyl-N—$\beta$-(methanesulfon-amido)ethylaniline sulfate 5 g | 4-Amino-3-methyl-N—ethyl-N—$\beta$ (methanesulfon-amido)ethylaniline sulfate 5 g |
| Sodium Sulfite | 2 g | 2 g | 2 g |
| Hydroxylamine Sulfate | 3 g | 3 g | 3 g |
| Potassium Carbonate | 30 g | 30 g | 30 g |
| Water to make | 1 l | 1 l | 1 l |
| pH (adjusted to) | 10.2 | 10.2 | 10.2 |

The composition of the bleach-fixing solution used was as follows.

Disodium Ethylenediaminetetraacetate—2 g
Ferric Salt of Ethylenediaminetetraacetic acid—40 g
Sodium Sulfite—5 g
Ammonium Thiosulfate—70 g
Water to make—1 l
pH was controlled to 6.8

The transmittance of the each sample were measured (the cyan, magenta or yellow density was measured according to each dye), and the maximum densities Dmax and $\gamma$ were determined. Results obtained are shown in Table 1 below.

TABLE 1

| Sample | Coupler | CD-1 Dmax | CD-1 $\gamma$ | CD-2 Dmax | CD-2 $\gamma$ | CD-3 Dmax | CD-3 $\gamma$ |
|---|---|---|---|---|---|---|---|
| A | Coupler (1) of the Present Invention | 3.22 | 2.30 | 3.18 | 2.26 | 3.25 | 2.33 |
| B | Coupler (3) of the Present Invention | 3.40 | 2.43 | 3.40 | 2.43 | 3.43 | 2.45 |
| C | Coupler (5) of the Present Invention | 3.35 | 2.38 | 3.30 | 2.35 | 3.38 | 2.42 |
| D | CR-1 | 2.80 | 1.88 | 2.23 | 1.43 | 2.78 | 1.90 |
| E | CR-2 | 2.65 | 1.52 | 2.01 | 1.22 | 2.72 | 1.58 |
| F | CR-3 | 3.01 | 2.00 | 2.83 | 1.91 | 3.12 | 2.12 |
| G | Coupler (6) of the Present Invention | 3.48 | 2.53 | 3.32 | 2.51 | 3.38 | 2.49 |
| H | Coupler (7) of the Present Invention | 3.93 | 2.67 | 3.89 | 2.59 | 3.92 | 2.65 |
| I | Coupler (9) of the Present Invention | 3.63 | 2.56 | 3.46 | 2.47 | 3.52 | 2.53 |
| J | MR-1 | 2.93 | 2.03 | 2.78 | 1.92 | 3.16 | 2.12 |
| K | MR-2 | 3.03 | 2.09 | 2.88 | 1.95 | 3.09 | 2.10 |
| L | MR-3 | 3.15 | 2.17 | 3.06 | 2.03 | 3.21 | 2.15 |
| M | Coupler (2) of the Present Invention | 3.32 | 2.39 | 3.28 | 2.39 | 3.35 | 2.41 |
| N | Coupler (4) of the Present Invention | 3.36 | 2.43 | 3.30 | 2.40 | 3.37 | 2.43 |
| O | Coupler (8) of the Present Invention | 3.41 | 2.50 | 3.36 | 2.48 | 3.40 | 2.48 |
| P | YR-1 | 3.01 | 1.98 | 2.64 | 1.57 | 2.99 | 1.95 |
| Q | YR-2 | 2.80 | 1.43 | 2.15 | 1.21 | 2.79 | 1.55 |
| R | YR-3 | 3.05 | 2.03 | 2.90 | 1.84 | 3.08 | 2.05 |

The comparative couplers used in the above evaluation had the following formulae.

CR-1
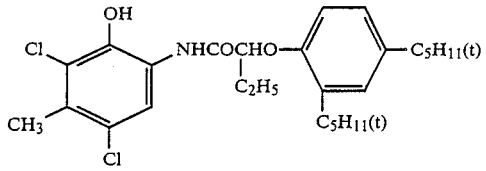
CR-2
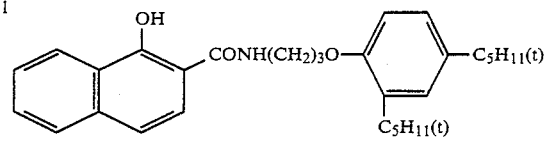
CR-3
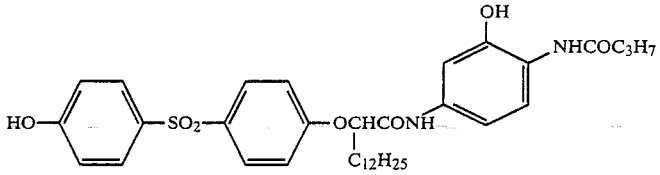
MR-1
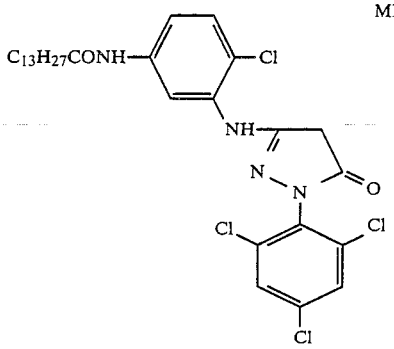
MR-2
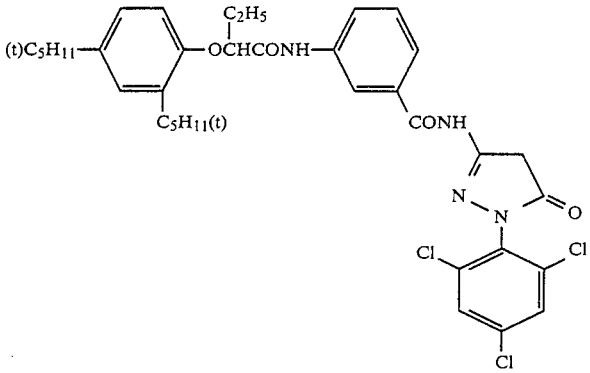
MR-3
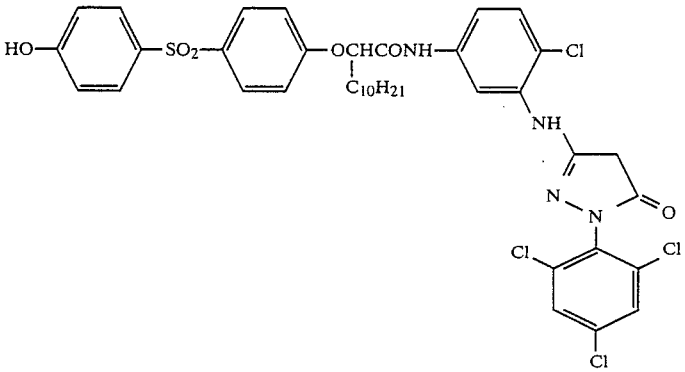
YR-1
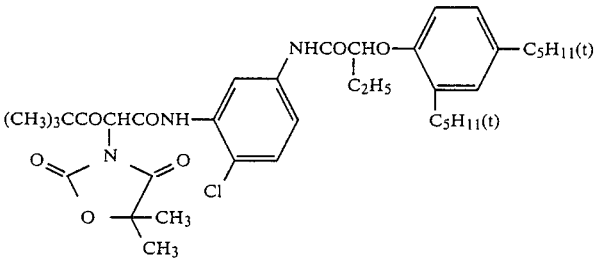

-continued

YR-2

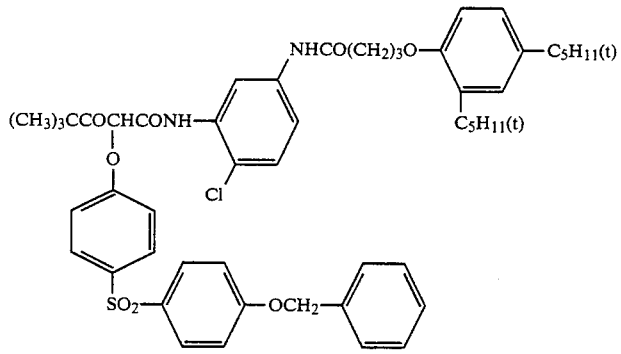

YR-3

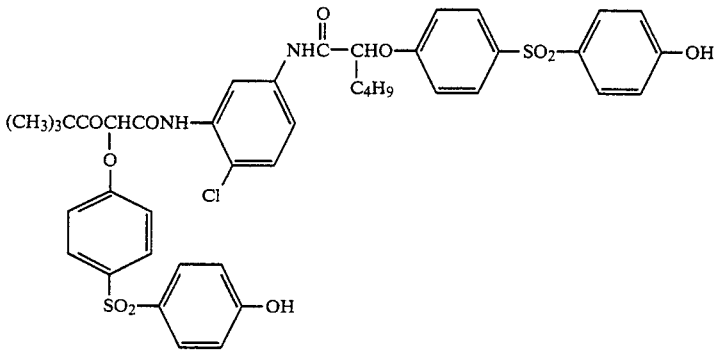

It can be seen from these results that samples containing the coupler of the present invention have excellent color formation in case of using any color developing solution, while comparative samples exhibit a low Dmax or $\gamma$ and have an inferior color forming property. Particularly, in comparison of color developer CD-2 and CD-3 each of which contains color developing agent having comparatively high activity, it can be seen that the comparative samples undergo great deterioration of color formation when color developer CD-2 which does not contain benzyl alcohol was used, while the samples of the present invention had sufficient color formation even in case that benzyl alcohol was not present, wherein the difference between CD-2 and CD-3 is small.

EXAMPLE 2

To a polyethylene both side-laminated paper, a first layer (the lowest layer) to a sixth layer (the top layer) were applied as shown in Table 2 below to produce color photographic light-sensitive materials (Samples A–C).

The coating solution for the first layer was prepared as follows. Specifically, 100 g of the yellow coupler shown in Table 1 above was dissolved in a mixture of 166.7 ml of dibutylphthalate (DBP) and 200 ml of ethyl acetate, and the resulting solution was dispersed by emulsification in 800 g of a 10% aqueous solution of gelatin containing 80 ml of a 1% aqueous solution of sodium dodecylbenzenesulfonate. Then, the resulting emulsified dispersion was blended with 1450 g (containing 66.7 g of Ag) of a blue-sensitive silver chlorobromide emulsion (Br 80%) to prepare a coating solution. Coating solutions for the other layers were prepared using the same manner. The sodium salt of 2,4-dichloro-6-hydroxy-s-triazine was used as a hardening agent for each layer.

Further, the following compounds were used as spectral sensitizers for each emulsion.

Blue-Sensitive Emulsion Layer: sodium salt of 3,3'-di-($\gamma$-sulfopropyl)selenocyanine ($2\times10^{-4}$ mols per mol of silver halide)

Green-Sensitive Emulsion Layer: sodium salt of 3,3'-di-($\gamma$-sulfopropyl)-5,5'-diphenyl-9-ethyloxacarbocyanine ($2.5\times10^{-4}$ mols per mol of silver halide)

Red-Sensitive Emulsion Layer: sodium salt of 3,3'-di-($\gamma$-sulfopropyl)-9-methyl-thiadicarbocyanine ($2.5\times10^{-4}$ mols per mol of silver halide).

The following dyes were used as anti-irradiation dyes in each emulsion layer.

Green-Sensitive Emulsion Layer:

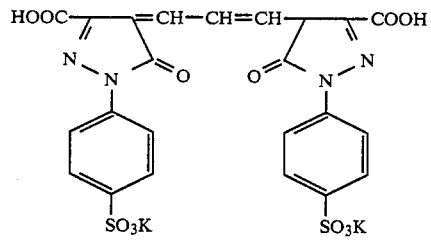

Red-Sensitive Emulsion Layer:

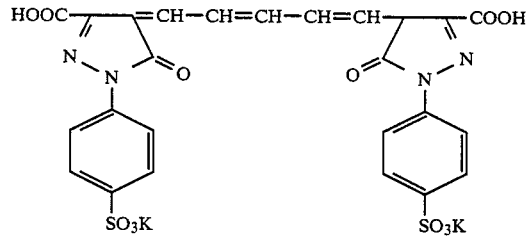

Chemical Structures of the solvents in Table 3 were as follows.

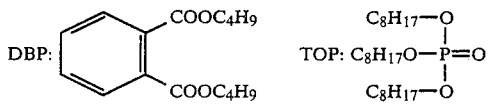

TABLE 2

| | | Sample No. | | |
|---|---|---|---|---|
| | | A | B | C |
| Sixth Layer: (protective layer) | Amount of Gelatin Coated | 1500 mg/m$^2$ | 1500 mg/m$^2$ | 1500 mg/m$^2$ |
| Fifth Layer: (red-sensitive layer) | Silver Chloro-bromide Emulsion (Br 50%) | | | |
| | Amount of Ag | 300 mg/m$^2$ | 300 mg/m$^2$ | 300 mg/m$^2$ |
| | Cyan Coupler | CR-1 | (16) | (21) |
| | Amount Coated | 400 mg/m$^2$ | 570 mg/m$^2$ | 560 mg/m$^2$ |
| | Solvent | DBP | DBP | DBP |
| | Amount of solvent used | 240 mg/m$^2$ | 340 mg/m$^2$ | 340 mg/m$^2$ |
| Fourth Layer: (Ultraviolet ray absorbing layer) | Amount of Gelatin Coated | 2000 mg/m$^2$ | 2000 mg/m$^2$ | 2000 mg/m$^2$ |
| | Ultraviolet Absorbing Agent king and amount | UV-1: 15 mg/m$^2$ UV-2: 45 mg/m$^2$ UV-3: 90 mg/m$^2$ | UV-1: 15 mg/m$^2$ UV-2: 45 mg/m$^2$ UV-3: 90 mg/m$^2$ | UV-1: 15 mg/m$^2$ UV-2: 45 mg/m$^2$ UV-3: 90 mg/m$^2$ |
| | Solvent | DBP | DBP | DBP |
| | Amount of solvent used | 60 mg/m$^2$ | 60 mg/m$^2$ | 60 mg/m$^2$ |
| Third Layer: (Green-sensitive layer) | Silver Chloro-bromide Emulsion (Br 70%) | | | |
| | Amount of Ag | 450 mg/m$^2$ | 450 mg/m$^2$ | 450 mg/m$^2$ |
| | Magenta Coupler | MR-1 | (20) | (24) |
| | Amount coated 350 mg/m$^2$ | 490 mg/m$^2$ | 430 mg/m$^2$ | |
| | Solvent | TOP | TOP | TOP |
| | Amount of solvent used | 440 mg/m$^2$ | 620 mg/m$^2$ | 540 mg/m$^2$ |
| Second Layer: (Interlayer) | Amount of Gelatin coated | 1500 mg/m$^2$ | 1500 mg/m$^2$ | 1500 mg/m$^2$ |
| First Layer: (Blue-sensitive layer) | Silver Chloro-bromide Emulsion (Br 80%) | | | |
| | amount of Ag | 1500 mg/m$^2$ | 1500 mg/m$^2$ | 1500 mg/m$^2$ |
| | Yellow Coupler | YR-1 | (22) | (27) |
| | Amount coated | 600 mg/m$^2$ | 720 mg/m$^2$ | 750 mg/m$^2$ |
| | Solvent | DBP | DBP | DBP |
| | Amount of solvent used | 1000 mg/m$^2$ | 1200 mg/m$^2$ | 1250 mg/m$^2$ |
| Support | Laminated paper support, both sides of which were laminated with polyethylene. | | | |

After each sample was exposed to light using a wedge for sensitometry, the sample was developed in the same manner as described in Example 1. Color developers in CD-2 and 3 were used as the color developers. The reflection densities (densities of red light, green light and blue light) of the resulting samples were measured and fog, Dmax and $\gamma$ of them were determined. The results shown in Table 3 below were obtained.

TABLE 3

| | Cyan | | | Magenta | | | Yellow | | |
|---|---|---|---|---|---|---|---|---|---|
| Sample | Fog | $\gamma$ | Dmax | Fog | $\gamma$ | Dmax | Fog | $\gamma$ | Dmax |
| | | | | CD - 2 | | | | | |
| A | 0.08 | 2.78 | 2.12 | 0.07 | 2.82 | 2.23 | 0.09 | 2.84 | 2.14 |
| B | 0.10 | 3.40 | 2.68 | 0.09 | 3.44 | 2.78 | 0.12 | 3.14 | 2.90 |
| C | 0.11 | 3.40 | 2.69 | 0.10 | 3.46 | 2.80 | 0.10 | 3.12 | 2.80 |
| | | | | CD - 3 | | | | | |
| A | 0.10 | 3.23 | 2.58 | 0.08 | 3.39 | 2.72 | 0.12 | 3.10 | 2.69 |
| B | 0.12 | 3.44 | 2.69 | 0.10 | 3.46 | 2.80 | 0.13 | 3.20 | 2.91 |
| C | 0.12 | 3.46 | 2.69 | 0.11 | 3.49 | 2.82 | 0.13 | 3.19 | 2.87 |

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material which contains a photographic coupler having a naphthalene nucleus in the bonding position other than the coupling position, wherein the naphthalene nucleus contains at least one hydroxyl group and at least one sulfonyl group as a substituent or contains at least one hydroxyl group and at least one sulfinyl group as a substituent.

2. The color photographic light-sensitive material of claim 1, wherein the photographic coupler having said naphthalene nucleus in the bonding position is a cyan coupler, a magenta coupler, a yellow coupler, a coupler forming a black dye or a coupler forming a grey dye.

3. The color photographic light-sensitive material of claim 1, wherein said naphthalene nucleus is a group represented by the following general formula (I) or (II):

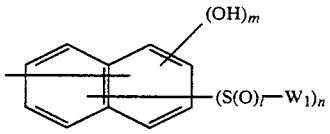

(I)

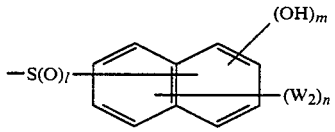

(II)

wherein the free bond represents a bond linking the group of the formulae (I) and (II) to the remainder of the coupler, l represents an integer of 1 or 2, m represents an integer of 1–3, n represents an integer of 1–3, $W_1$ represents an unsubstituted or substituted cyclic, straight-chain or branched-chain saturated or unsaturated alkyl group, an unsubstituted or substituted aryl group, a heterocyclic group containing at least one of a nitrogen atom, a sulfur atom and an oxygen atom besides carbon atoms, an amino group which may be substituted by an alkyl group, an acylamino group, an alkoxy group, an anilino group or a fluorine atom, and $W_2$ represents a substituent as described for $W_1$ or a hydrogen atom, a chlorine atom, a bromine atom, a carboxyl group, a nitro group, a nitroso group, a cyano group, an alkoxycarbonyl group, a carbamoyl group, a ureido group, an alkoxycarbonylamino group, an imido group, an alkylthio group, an arylthio group, a sulfamoyl group, an alkylsulfonyl group, an arylsulfonyl group, a sulfonamido group, an aryloxy group, an imino group or an acyl group.

4. The color photographic light-sensitive material of claim 3, wherein said couplers are represented by the following general formulae (III), (IV), (V) and (VI)

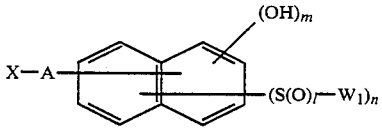

(III)

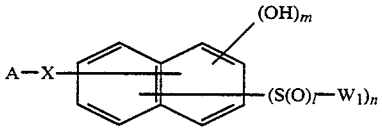

(IV)

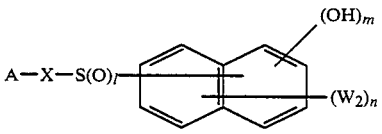

(V)

-continued

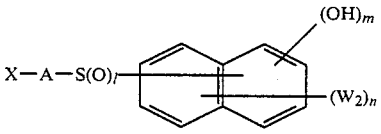

(VI)

wherein $W_1$, $W_2$, l, m and n each have the same meaning as defined in the general formulae (I) and (II) in claim 3, A represents a coupler residue, and X represents an organic residue bonding to the coupler residue A at the coupling position thereof.

5. The color photographic light-sensitive material of claim 4, wherein A is a yellow image forming coupler residue selected from the group consisting of a pivaloylacetanilide residue, a benzoylacetanilide residue, a malonic diester residue, a malonic diamide residue, a dibenzoylmethane residue, a benzothiazolylacetamide residue, a malonic ester monoamide residue, a benzothiazolylacetate residue, a benzoxazolylacetamide residue, a benzoxazolylacetate residue, a benzimidazolylacetamide residue or a benzimidazolylacetate residue, a coupler residue derived from a heterocyclic substituted acetamide, a coupler residue derived from a heterocyclic substituted acetate, a coupler residue derived from an acylacetamide or a heterocyclic coupler residue, a magenta image forming coupler residue selected from the group consisting of a 5-oxo-2-pyrazoline residue, a pyrazolobenzimidazole residue, a pyrazolotriazole residue, a cyanoacetophenone residue and an N-heterocyclic substituted acylacetamide residue, a cyan image forming coupler residue selected from the group consisting of a phenol residue and an α-naphthol residue, or residue which does not substantially form a dye selected from the group consisting of an indanone residue and an acetophenone residue.

6. The color photographic light-sensitive material of claim 5, wherein X represents a hydrogen atom or a group releasable on coupling.

7. The color photographic light-sensitive material of claim 6, wherein X is an alkoxy group, an acyloxy group, an aryloxy group, an arylthio group, a heterocyclic thio group, an alkylthio group, a sulfonamido group, a heterocyclic oxy group, a nitrogen-containing 5-member or 6-member heterocyclic group, a benzene condensed heterocyclic group, an arylazo group, a chlorine atom or an aliphatic aminomethyl group.

8. The color photographic light-sensitive material of claim 7, wherein X contains as a substituent a saturated or unsaturated cyclic, straight-chain or branched-chain alkyl group having 1 to 32 carbon atoms, an aryl group having 6 to 10 carbon atoms, a halogen atom, a cyano group, a nitro group, a nitroso group, a carboxyl group, a carbamoyl group, a sulfo group, a hydroxy group, an amino group, a sulfamoyl group, a ureido group, an alkoxy group having 1 to 32 carbon atoms, an acylamino group, an alkoxycarbonyl group, an alkoxycarbonylamino group, an alkylsulfonamido group, an N-alkyl (or N,N-dialkyl)-sulfamoyl group, an N-alkyl (or N,N-dialkyl)-carbamoyl group, an alkanesulfonyl group, an alkanoyl group, an alkanoyloxy group, an alkylthio group, an aryloxy group having 6 to 10 carbon atoms, an aryloxycarbonyl group, an arylsulfonamido group, an N-arylsulfamoyl group, an arylsulfonyl group, an arylthio group, an arylcarbonyl group, an N-arylcarbamoyl group, an arylureido group and an aryloxycarbamoyl group.

9. The color photographic light-sensitive material of claim 4, wherein any of A, X, $W_1$ and $W_2$ may contain as an antidiffusion group a group containing an alkyl group having 8 to 32 carbon atoms which may contain one or more of, as linking groups, a phenylene bond, an ether bond, a carbonamido bond, a sulfonamido bond, a ureido bond, a sulfone bond, a thioether bond, a urethane bond, an ester bond, an imido bond, a sulfamido bond, a sulfonediimido bond or a carbonyl bond.

10. The color photographic light-sensitive material of claim 4, wherein A in the general formula (III), (IV), (V) or (VI) represents a coupler residue represented by the following general formula (VII), (VIII), (IX), (X), (XI), (XII), (XIII), (XIV), (XV) or (XVI):

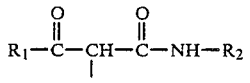

(VII)

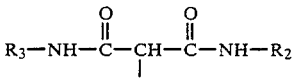

(VIII)

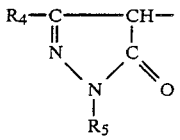

(IX)

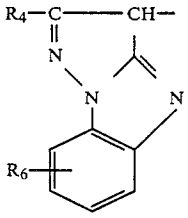

(X)

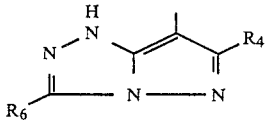

(XI)

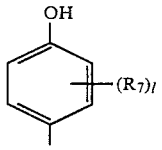

(XII)

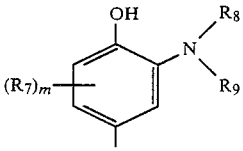

(XIII)

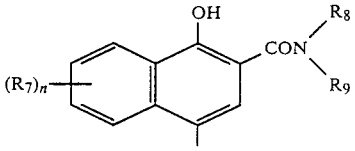

(XIV)

-continued

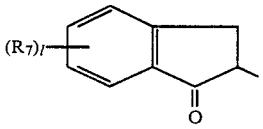

(XV)

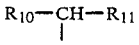

(XVI)

wherein the free bond at the coupling position represents the bonding position of the coupling releasing group, $R_1$ represents an aliphatic group, an aromatic group, an alkoxy group or a heterocyclic group, and $R_2$ and $R_3$ represent each an aromatic group or a heterocyclic group; where the aliphatic group for $R_1$ is selected from the group consisting of an aliphatic group having 1 to 22 carbon atoms, which is in the form of a chain or is cyclic, and which may be unsubstituted or substituted with one or more alkoxy group, aryloxy groups, amino groups, acylamino groups and halogen atoms, where the aromatic group for $R_1$, $R_2$ and $R_3$ is an aromatic group which may be substituted with one or more alkyl groups, alkenyl groups, alkoxy groups, alkoxycarbonyl groups, alkoxycarbonylamino groups, aliphatic amido groups, alkylsulfamoyl groups, alkylsulfonamido group, alkylureido groups or alkyl substituted succinimido groups, each having 32 or less carbon atoms, where the alkyl group may contain an aromatic group in the chain, aryloxy groups, aryloxy carbonyl groups, arylcarbamoyl groups, arylamido groups, arylsulfamoyl groups, arylsulfonamido groups or aryureido groups, wherein the aryl moiety of these substituents may be further substituted by one or more alkyl groups having a total of 1 to 22 carbon atoms, an amino group which may be substituted with one or more lower alkyl groups having 1 to 6 carbon atoms, hydroxyl groups, carboxyl groups, sulfo groups, nitro groups, cyano groups, thiocyano groups or halogen atoms, and substituents in which a phenyl group is condensed with another ring to form a naphthyl group, a quinolyl group, an isoquinolyl group, a chromanyl group, a coumaranyl group or a tetrahydronaphthyl group, which may also be substituted where the heterocyclic group for $R_1$, $R_2$ and $R_3$ is a heterocyclic group linked to the carbon atom of the carbonyl moiety of the acyl group in the α-acylacetamido group or the nitrogen atom of the amido group in the α-acylacetamido group through one of the carbon atoms of the ring; $R_5$ represents a straight-chain or branched-chain alkyl group an alkenyl group, a cycloalkyl group, an aralkyl group or a cycloalkenyl group each having 1 to 32 carbon atoms, each of which may be substituted by one or more halogen atoms, nitro groups, cyano groups, aryl groups, alkoxy groups, aryloxy group, carboxyl group, alkylthiocarbonyl groups, arylthiocarbonyl groups, alkoxycarbonyl groups, aryloxycarbonyl groups, sulfo groups, sulfamoyl groups, carbamoyl groups, acylamino groups, diacylamino groups, ureido groups, urethane groups, thiourethane groups, sulfoamido groups, heterocyclic groups, arylsulfonyl groups, alkylsulfonyl groups, arylthio groups, alkylthio groups, alkylamino groups, dialkylamino groups, anilino groups, N-arylanilino groups, N-alkylanilino groups, N-acylanilino groups, hydroxyl groups or mercapto groups, an aryl group which may be substituted with one or more alkyl groups, alkenyl groups, cycloalkyl groups, aralkyl groups, cycloalkenyl groups, halogen atoms, nitro groups, cyano groups, aryl groups, alkoxy groups, aryloxy groups, carboxyl groups, alkoxycarbonyl groups, aryloxycarbonyl groups, sulfo groups, sulfamoyl groups, carbamoyl groups, acylamino groups, diacylamino groups, ureido groups, urethane groups, sulfonamido groups, heterocyclic groups, arylsulfonyl groups, alkylsulfonyl groups, arylthio groups, alkylthio groups, alkylamino groups, dialkylamino groups, anilino groups, N-alkylanilino groups, N-arylanilino groups, N-acylanilino groups, hydroxyl groups and mercapto groups, a heterocyclic group, a heterocyclic group substituted by substituents as described for the above described aryl group for $R_5$, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group; $R_4$ represents a hydrogen atom, a straight-chain or branched-chain alkyl, alkenyl, cycloalkyl aralkyl or cycloalkenyl group having 1 to 32 carbon atoms which may be substituted with substituents as described above for $R_5$, an aryl group which may be substituted with substituents as described above for $R_5$, a heterocyclic group which may be substituted with substituents as described above for $R_5$, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group a sulfonamido group, carbamoyl group, a sulfamoyl group, a cyano group, a hydroxy group, a mercapto group, a halogen atom or a sulfo group; $R_6$ represents a hydrogen atom or a straight-chain or branched-chain alkyl group, an alkenyl group, a cycloalkyl group, an aralkyl group, or a cycloalkenyl group having 1 to 32 carbon atoms, which may be substituted with substituents as described above for $R_5$, an aryl group or a heterocyclic group, each of which may be substituted with substituents as described above for $R_5$, a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group or a mercapto group, $R_7$, $R_8$ and $R_9$ each represent a hydrogen atom, a halogen atom, an alkoxycarbonylamino group, an aliphatic hydrocarbon residue, an N-arylureido group, an acylamino group, —O—$R_{12}$ or —S—$R_{12}$, wherein $R_{12}$ represents an aliphatic hydrocarbon residue and where these substituents for $R_7$, $R_8$ and $R_9$ contain an aryl group, the aryl group may be substituted with substituents as described above for $R_5$ and further $R_8$ and $R_9$ each represent a group selected from the group consisting of aliphatic hydrocarbon residues, aryl groups and heterocyclic residues, each of which may be substituted, one of $R_8$ and $R_9$ may represent a hydrogen atom and $R_8$ and $R_9$ may combine and form a nitrogen containing heterocyclic nucleus, l represents an integer of 1 to 4, m represents an integer of 1 to 3, and n represents an integer of 1 to 5, $R_{10}$ represents an arylcarbonyl group, an alkanoyl group having 2 to 32 carbon atoms, an arylcarbamoyl group, an alkanecarbamoyl group having 2 to 32 carbon atoms, an alkoxycarbonyl group having 2 to 32 carbon atoms or an aryloxycarbonyl group, each of which may be substituted with one or more alkoxy groups, alkoxycarbonyl groups, acylamino groups, alkylsulfamoyl groups, alkylsulfonamido groups, alkylsuccinimido groups, halogen atoms, nitro groups, carboxyl groups, cyano groups, alkyl groups and aryl groups, and $R_{11}$ represents an arylcarbonyl group, an alkanoyl group having 2 to 32 carbon atoms, an arylcarbamoyl group, an alkanecarbamoyl group having 2 to 32 carbon atoms, an alkoxycarbonyl group having 1 to 32 carbon atoms, an aryloxycarbonyl group, an alkanesulfonyl group having 2 to 32 carbon atoms, an arylsulfonyl group, an aryl group or a 5-member or 6-member heterocyclic group, where the hetero atom is a nitrogen atom, an oxygen atom or a sulfur atom, which may be substituted with substituents as described for $R_{10}$.

* * * * *